US006615786B2

(12) United States Patent
Mori et al.

(10) Patent No.: US 6,615,786 B2
(45) Date of Patent: Sep. 9, 2003

(54) STARTER SYSTEM FOR INTERNAL COMBUSTION ENGINE

(75) Inventors: Ryuichi Mori, Saitama-ken (JP); Junya Tachikawa, Saitama-ken (JP); Koichi Fushimi, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/123,249

(22) Filed: Apr. 17, 2002

(65) Prior Publication Data

US 2002/0166532 A1 Nov. 14, 2002

(30) Foreign Application Priority Data

May 11, 2001 (JP) ..... 2001-141657
May 29, 2001 (JP) ..... 2001-161367
Jul. 13, 2001 (JP) ..... 2001-213429

(51) Int. Cl.[7] ..... F02N 7/00

(52) U.S. Cl. ..... 123/179.31; 74/7 C; 74/7 E; 60/626

(58) Field of Search ..... 123/179.31, 179.25; 60/625, 626, 627; 74/7 C, 7 E

(56) References Cited

U.S. PATENT DOCUMENTS 2,200,781 A * 5/1940 Smith ..... 123/179.31
6,460,500 B1 * 10/2002 Ooyama et al. ..... 123/179.31

FOREIGN PATENT DOCUMENTS

JP 01138369 A * 5/1989 ..... F02N/11/00

* cited by examiner

*Primary Examiner*—Henry C. Yuen
*Assistant Examiner*—Arnold Castro
(74) *Attorney, Agent, or Firm*—Arent Fox Kintner Plotkin & Kahn, PLLC

(57) ABSTRACT

There is provided a starter system for an internal combustion engine, which is capable of preventing wear of a brush of an electric motor ascribable to the combined use of the electric motor with a hydraulic actuator and the resulting increase in the rotational resistance due to friction of the brush, as well as capable of using one of the hydraulic actuator and the electric motor without difficulty even when the other is disabled. The hydraulic motor is driven by hydraulic pressure. A rotational shaft of the hydraulic motor is driven for rotation by the hydraulic motor. A rotational shaft of an electric motor extends in parallel with the rotational shaft of the hydraulic motor, and is driven for rotation by the electric motor. A ring gear rotates in unison with the crankshaft. A pinion gear is brought into meshing engagement with the ring gear, for starting the engine. An output shaft is connected to the pinion gear. A first one-way clutch connects the rotational shaft of the hydraulic motor and the output shaft to each other in a disconnectable manner, for transmitting rotation of the hydraulic motor to the output shaft. A second one-way clutch connects the rotational shaft of the electric motor and the output shaft to each other in a disconnectable manner, for transmitting rotation of the rotational shaft of the electric motor to the output shaft.

10 Claims, 12 Drawing Sheets

STARTER SYSTEM FOR INTERNAL COMBUSTION ENGINE

BACKGROUND OF THE INVENTION

1. Field of the Invention

This invention relates to a starter system for an internal combustion engine, for starting the engine by a hydraulic actuator driven by hydraulic pressure.

2. Description of the Prior Art

Conventionally, a starter system of this kind has been proposed e.g. by Japanese Laid-Open Patent Publication (Kokai) No. 2001-82202. FIG. 12 schematically shows the arrangement of the starter system. This starter system 350, which is a hydraulic motor-driven type, is comprised of an electric motor 351, an oil pump 352 driven by the electric motor 351, an accumulator 353 for storing hydraulic pressure boosted by the oil pump 352, a hydraulic motor 355 connected to the accumulator 353 via an oil passage 354, and a solenoid valve 356 arranged in the oil passage 354. A drive shaft 355*a* of the hydraulic motor 355 is connected to a drive shaft 359*a* of a timing pulley 359 via a reduction gear 357 and a one-way clutch 358. The timing pulley 359 is connected to a timing pulley 362 of an internal combustion engine (hereinafter referred to as "the engine") 361 via a synchronous timing belt 360. Further, the timing pulley 362 is mounted to one end of a crankshaft 363.

According to the above construction, when the engine 361 is started, the solenoid valve 356 opens the oil passage 354, whereby hydraulic pressure is supplied from the accumulator 353 to the hydraulic motor 355 to drive the same for rotation. Then, the rotation of the hydraulic motor 355 is transmitted to the crankshaft 363 via the reduction gear 357, the one-way clutch 358 and the synchronous timing belt 360 to thereby start the engine 361. During operation of the engine 361 after the start thereof, transmission of torque from the crankshaft 363 to the hydraulic motor 355 is inhibited by action of the one-way clutch 358.

In general, if an engine stops halfway in a compression stroke when the operation of the engine is stopped or when the start of the same has failed, the crankshaft of the engine can be urged by pressure of the compressed air to rotate reversely to a stable position. In this case, since the direction of torque is reversed from the normal direction thereof, the one-way clutch 358 of the above starter system 350 transmits reverse torque to the hydraulic motor 355. This causes the hydraulic motor 355 to rotate in the reverse direction to act as a hydraulic pump. On the other hand, the oil passage 354 is held in a closed state by the solenoid valve 356 except when the engine is started. As a result, the hydraulic fluid pressurized to a high pressure level when the operation of the engine is stopped flows into the closed portion of the oil passage 354 between the hydraulic motor 355 and the solenoid valve 356, thereby developing high impact pressure within the oil passage 354. The high impact pressure causes the drive shaft 355*a* of the hydraulic motor 355 to generate large impact torque which can adversely affect a torque-transmitting system including the hydraulic motor 355 and the one-way clutch 358 as well as a hydraulic circuit system including the solenoid valve 356 and the oil passage 354. Similarly, when the start of the engine has failed, although the oil passage 54 is held open by the solenoid valve 356, high impact pressure can be generated e.g. due to a pressure loss in the solenoid valve 356.

Further, another starter system of the above-mentioned kind has been proposed e.g. by Japanese Laid-Open Utility Model Publication (Kokai) No. 59-73579. This starter system includes an electric motor, and a hydraulic motor, and is capable of starting an engine by selectively using the two motors. The electric motor has a pinion gear splined to a rotational shaft thereof. At the start of the engine, a plunging mechanism causes the pinion gear to axially slide toward the engine, for meshing engagement with a ring gear integrally formed with a crankshaft of the engine. On the other hand, the hydraulic motor is arranged on an opposite side to the pinion gear with respect to the electric motor, and serially connected to the electric motor via a one-way clutch arranged coaxially with the rotational shaft of the hydraulic motor. The hydraulic motor is driven by hydraulic pressure accumulated within the accumulator. The operation or stoppage of the hydraulic motor is controlled according to the hydraulic pressure accumulated in the accumulator, by opening and closing of a solenoid valve arranged between the accumulator and the hydraulic motor. The pressure accumulation is carried out by utilizing regenerative energy under conditions that the hydraulic pressure within the accumulator is equal to or lower than a predetermined value and that the vehicle is decelerating.

According to this starter system, when the engine is started, the pinion of the electric motor is brought into meshing engagement with the ring gear by the plunging mechanism, and when the hydraulic pressure within the accumulator is equal to or higher than the predetermined value, the hydraulic motor is driven. As a result, torque of the hydraulic motor is transmitted to the rotational shaft of the electric motor via the one-way clutch, and then further transmitted from the pinion gear to the ring rear, whereby the engine is started. On the other hand, when the hydraulic pressure within the accumulator is lower than the predetermined value, the hydraulic motor is stopped, and the electric motor is driven to start the engine. In this case, the electric motor and the hydraulic motor are disconnected from each other by the one-way clutch, which prevents the hydraulic motor from applying rotational load to the electric motor.

Normally, the hydraulic motor and the electric motor have respective different torque characteristics. More specifically, the hydraulic motor provides larger output torque than the electric motor, and the rise of rotational speed of the hydraulic motor is more rapid than that of the electric motor. Therefore, the hydraulic motor is characterized by being capable of starting the engine quickly. The quick starting of the engine is advantageous in reducing a time period during which the pinion gear and the ring gear are engaged with each other, thereby suppressing generation of noise due to the engagement between the two gears, as well as in ensuring smooth startability when the engine is frequently stopped and started by application of "idle stop" e.g. in traffic congestion. The "idle stop" is an engine operation control technique for stopping the operation of the engine when the engine speed is low under predetermined operating conditions of the engine including a fully warmed-up condition thereof. This technique has come to be increasingly valued as measures of environmental protection and fuel economy.

However, in the above conventional starter system, since the hydraulic motor is serially connected to the rotational shaft of the electric motor, when the engine is to be started by the electric motor, transmission of torque from the electric motor to the hydraulic motor is inhibited by free or idle rotation of the one-way clutch, whereas when the engine is to be started by the hydraulic motor, the torque of the hydraulic motor is transmitted to the electric motor via the one-way clutch, whereby the electric motor is caused to rotate at the same rotational speed as the hydraulic motor. This makes a brush in constant contact with the rotational shaft of the electric motor prone to wear or abrasion. This wear of the brush is particularly conspicuous when the high torque characteristic of the hydraulic motor is utilized for restarting the engine in an idle stop mode, so as to start the engine quickly, because the starting rotational speed of the engine is higher than when the electric motor is used. As the brush wears to a larger degree, the rotational resistance due to friction is increased, whereby transmission efficiency in transmitting torque from the hydraulic motor to the engine is lowered. This adversely affects the startability of the engine, and makes it necessary to design a hydraulic motor such that it has an larger output.

Further, as the hydraulic motor increases the starting rotational speed, the electric motor is required to be designed to have a robuster structure so as to endure high rotational speeds, though it is not originally necessary for engine starting operation, resulting in an extra increase in costs. Moreover, when the electric motor is disabled by fixture of movable components caused by entry of a foreign matter, it is also impossible to start the engine by using the hydraulic motor, so that the starting of the engine becomes totally impossible. In short, if quick starting by the hydraulic motor is to be executed so as to take advantage of the above characteristic of the hydraulic motor, it is required to employ an expensive electric motor capable of enduring high rotational speeds, which results in an increase in manufacturing costs. A possible solution to this problem is to provide overdrive/reduction mechanisms having respective different overdrive/reduction characteristics for the hydraulic motor and the electric motor, respectively. In this case, however, it is necessary to design another starter system anew, which also causes an increase in manufacturing costs. In addition, space for arranging the two overdrive/reduction mechanisms is needed, and hence the starter system is inevitably increased in size.

SUMMARY OF THE INVENTION

It is a first object of the invention to provide a starter system for an internal combustion engine, which is capable of preventing wear of a brush of an electric motor ascribable to the combined use of the electric motor with a hydraulic actuator and the resulting increase in the rotational resistance due to friction of the brush, as well as capable of using one of the hydraulic actuator and the electric motor without difficulty even when the other is disabled.

It is a second object of the invention to provide a starter system for an internal combustion engine, which is capable of starting the engine by selectively making use of a driving force from a hydraulic actuator or a driving force from an electric motor at a properly increased or decreased rotational speed without any interference therebetween, and which can be constructed by a compact design and at a reduced cost.

It is a third object of the invention to provide a starter system for an internal combustion engine, which is capable of preventing a hydraulic actuator, a hydraulic pressure supply control valve and an oil passage from being adversely affected by reverse torque from the engine due to stoppage of operation of the engine or failure in starting the same.

To attain the above objects, the present invention provides a starter system for an internal combustion engine, for starting the engine by driving a crankshaft for rotation, the starter system comprising:

a hydraulic actuator that is driven by hydraulic pressure;

a first rotational shaft that is driven for rotation by the hydraulic actuator;

an electric motor;

a second rotational shaft that extends in parallel with the first rotational shaft and is driven for rotation by the electric motor;

a driven gear that rotates in unison with the crankshaft;

a driving gear that is brought into meshing engagement with the driven gear when the engine is started;

a third rotational shaft that is connected to the driving gear;

a first driving force-transmitting mechanism that connects the first rotational shaft and the third rotational shaft to each other in a disconnectable manner, for transmitting rotation of the first rotational shaft to the third rotational shaft; and a second driving force-transmitting mechanism that connects the second rotational shaft and the third rotational shaft to each other in a disconnectable manner, for transmitting rotation of the second rotational shaft to the third rotational shaft.

According to this starter system for an internal combustion engine, the first rotational shaft that is driven for rotation by the hydraulic actuator and the second rotational shaft that is driven for rotation by the electric motor extend in parallel with each other. Further, the first driving force-transmitting mechanism disconnectably connects the first rotational shaft to the third rotational shaft having the driving gear connected thereto, while the second driving force-transmitting mechanism disconnectably connects the second rotational shaft to the third rotational shaft. In this construction, when the engine is to be started by the hydraulic actuator, the driving gear is brought into meshing engagement with the driven gear which rotates in unison with the crankshaft, and the hydraulic actuator is driven with the first driving force-transmitting mechanism being held in a connection state in which this mechanism connects the first and third rotational shafts and the second driving force-transmitting mechanism being held in a disconnection state in which this mechanism disconnects the second and third rotational shafts from each other. As a result, the rotation or torque of the hydraulic actuator is transmitted to the third rotational shaft via the first rotational shaft and the first driving force-transmitting mechanism, and then further transmitted to the driven gear via the driving gear, whereby the engine is started. In this case, since the second rotational shaft is held disconnected from the third rotational shaft by the second driving force-transmitting mechanism, no driving force is transmitted from the engine or the hydraulic actuator to the electric motor, and hence the electric motor is neither caused to rotate nor offers a rotational resistance.

As described above, the starter system of the present invention makes it possible to selectively transmit one of the driving forces of the hydraulic actuator and the electric motor to the internal combustion engine in a state of transmission of a driving force between the hydraulic actuator and the electric motor being completely inhibited, thereby starting the engine. In other words, whichever of the hydraulic actuator and the electric motor may be used to start the engine, the hydraulic actuator or the electric motor can be operated independently of each other without causing rotation of the other. As a result, it is possible to prevent wear of a brush of the electric motor due to the use of the electric motor in combination with the hydraulic actuator, and an increase in rotational resistance due to friction resulting from the wear of the brush. Further, it is not necessary to provide an extra design so as to increase the robustness of the electric motor to adapt the same to the high rotational speed characteristic of the hydraulic actuator. Moreover, even when one of the hydraulic actuator and the electric motor is disabled, it is possible to use the other to start the engine without any difficulty.

Preferably, the first and second driving force-transmitting mechanisms are formed by respective first and second one-way clutches that allow transmission of respective rotations of the first and second rotational shafts to the third rotational shaft only when the first and second rotational shafts rotate in respective directions for driving the third rotational shaft.

According to this preferred embodiment, when the engine is to be started by the hydraulic actuator, the rotation of the first rotational shaft is transmitted to the third rotational shaft via the first one-way clutch, whereas the second one-way clutch performs idle or free rotation so that the second and third rotational shafts are in a state disconnected from each other. On the other hand, when the engine is to be started by the electric motor, inversely to the above case, the rotation of the second rotational shaft is transmitted to the third rotational shaft via the second one-way clutch, whereas the first one-way clutch performs idle or free rotation so that the first and third rotational shafts are in a state disconnected from each other. Thus, by implementing the first and second driving force-transmitting mechanisms by the respective one-way clutches, it is possible to make use of one of the hydraulic actuator and the electric motor and at the same time hold the other in a disconnected state, through the simple arrangement including the clutches, to thereby start the engine, with ease and without any need to execute control operation therefor.

Preferably, the starter system includes a planetary gear set having a sun gear, a carrier, and a ring gear, the second rotational shaft being connected to one of the sun gear, the carrier, and the ring gear, and the first rotational shaft being connected to another of the sun gear, the carrier, and the ring gear of the planetary gear set, and the third rotational shaft being connected to a remaining one of the sun gear, the carrier, and the ring gear of the planetary gear set.

According to this preferred embodiment, the second rotational shaft driven by the electric motor, the first rotational shaft driven by the hydraulic actuator, and the third rotational shaft provided with the driving gear are connected to one, another, and the remaining one of the sun gear, the carrier, and the ring gear of the planetary gear set. Accordingly, when the engine is to be started by the hydraulic actuator, the driving gear is brought into meshing engagement with the driven gear integrally formed with the crankshaft, and at the same time, the hydraulic actuator is driven for rotation by hydraulic pressure accumulated in the accumulator. As a result, the rotation of the first rotational shaft driven by the hydraulic actuator is transmitted from the another of the sun gear, the carrier, and the ring gear to the third rotational shaft via the remaining one of these, and then further transmitted to the driven gear via the driving gear, whereby the engine is started. On the other hand, when the engine is to be started by the electric motor, the driven gear is brought into meshing engagement with the driving gear, and the electric motor is driven for rotation. The rotation of the second rotational shaft driven by the electric motor is transmitted from the one of the sun gear, the carrier, and the ring gear to the third rotational shaft via the remaining one, and further via the driving gear to the driven gear, whereby the engine is started.

As described above, according to the above preferred embodiment, it is possible to transmit the driving force of the hydraulic actuator or the electric motor to the third rotational shaft via the planetary gear set without causing interference between the hydraulic actuator and the electric motor. Further, since the driving force-transmitting mechanism for the hydraulic actuator and the electric motor is formed by a single planetary gear set, it is possible to make the starter system compact in size and manufacture the same at a reduced cost.

More preferably, the starter system further comprises first fixing means for fixing the one of the sun gear, the carrier, and the ring gear, to which the second rotational shaft that is driven by the electric motor for rotation is connected, when the engine is to be started by the hydraulic actuator, and second fixing means for fixing the another of the sun gear, the carrier, and the ring gear, to which the first rotational shaft that is driven by the hydraulic actuator for rotation is connected, when the engine is to be started by the electric motor.

According to this preferred embodiment, when the engine is to be started by the hydraulic actuator, the driving force of the hydraulic actuator is taken out by fixing or making immovable the one of the sun gear, the carrier and the ring gear, to which the second rotational shaft that is driven by the electric motor for rotation is connected, by using the first fixing means, and delivered to the third rotational shaft at an overdrive/reduction ratio dependent on the gear ratio of the planetary gear set. Similarly, when the engine is to be started by the electric actuator, the driving force of the electric motor is taken out by fixing or making immovable the one of the sun gear, the carrier and the ring gear, to which the first rotational shaft that is driven by the hydraulic actuator for rotation is connected, by using the second fixing means, and delivered to the third rotational shaft at an overdrive/reduction ratio different from that in the case of the hydraulic actuator being used. Thus, one of the driving forces of the hydraulic actuator and the electric motor can be selectively taken out without causing any interference between the hydraulic actuator and the electric motor, as well as to obtain overdrive/reduction ratios different from each other. In short, the planetary gear set functions not only as a driving force-transmitting mechanism, but also as an overdrive/reduction mechanism for the hydraulic actuator and the electric motor. This makes it possible to manufacture the starter system further compact in size at a reduced cost.

Alternatively, if the first and second fixing means are formed by respective locking means for mechanically locking the second rotational shaft that is driven by the electric motor and the first rotational shaft that is driven by the hydraulic actuator, fixing operations by the respective fixing means can be performed by mechanically locking the respective first and second rotational shafts, so that it is possible to easily and reliably carry out switching between the output of the driving force of the hydraulic actuator and that of the driving force of the electric motor.

Further preferably, the starter system further comprises an accumulator for storing hydraulic pressure, an oil passage connected to the accumulator, and third fixing means for fixing the remaining one of the sun gear, the carrier, and the ring gear, to which the third rotational shaft that is connected to the driven gear is connected, to thereby transmit a driving force of the electric motor to the hydraulic actuator and cause the hydraulic actuator to rotate the first rotational shaft in a direction opposite to a direction in which the first rotational shaft is driven for rotation, to thereby cause the hydraulic pressure to be accumulated in the accumulator via the oil passage.

According to this preferred embodiment, hydraulic pressure is accumulated in the accumulator by fixing the remaining one of the sun gear, the carrier, and the ring gear, to which the third rotational shaft is connected, to thereby transmit the driving force of the electric motor to the hydraulic actuator and cause reverse rotation of the first rotational shaft, whereby the hydraulic pressure is accumulated in the accumulator. Thus, it is possible to utilize the hydraulic actuator to accumulate the hydraulic pressure in the accumulator, and hence a dedicated oil pump or electric motor for the pressure accumulation can be dispensed with.

Alternatively, if the above third fixing means is formed by locking means for mechanically locking the third rotational shaft, the fixing operation by the third fixing means can be performed by mechanically locking the third rotational shaft, so that the hydraulic actuator can easily and reliably perform operation for the pressure accumulation.

Preferably, the third rotational shaft is connected to the ring gear, the second rotational shaft is connected to the sun gear, and the first rotational shaft is connected to the carrier.

As described in Description of the Prior Art, when the torque characteristic of the hydraulic actuator and that of the electric motor are compared with each other, the output torque of the hydraulic actuator is larger and hence suitable for quick starting by overdrive, whereas the output torque of the electric motor is smaller, and hence it is preferably output at a reduced rotational speed. According to the above preferred embodiment, since the output shaft (third rotational shaft), the electric motor, and the hydraulic actuator are each connected to the planetary gear set as described above, the rotation of the electric motor is output at a reduced rotational speed, while that of the hydraulic actuator is output at an increased rotational speed. Therefore, the starter system can be easily selectively placed in respective operative statuses in which the rotational speed of the output shaft is increased and decreased, in a manner adapted to the respective torque characteristics of the hydraulic actuator and the electric motor.

Preferably, the starter system of the invention further comprises a hydraulic pressure supply control valve arranged in the oil passage connected to the hydraulic actuator, for controlling the hydraulic pressure to be supplied to the hydraulic actuator via the oil passage, and a torque limiter mechanism for suppressing an increase in the hydraulic pressure when a reverse torque equal to or larger than a predetermined value and acting in a direction opposite to a direction for starting the engine acts on the hydraulic actuator during stoppage of rotation of the engine.

According to this preferred embodiment, when the engine is started, the hydraulic pressure supply control valve opens the oil passage to permit supply of hydraulic pressure to the hydraulic actuator via the oil passage, whereby the hydraulic actuator is driven for rotation. The rotation of the hydraulic actuator is transmitted to the engine, whereby the engine is started. Further, even if a reaction force from the engine generated due to stoppage of the engine or failure in starting the same causes reverse rotation of the engine, causing the hydraulic actuator to act as an oil pump to increase the hydraulic pressure, the torque limiter mechanism prevents the hydraulic pressure from being further increased when a reverse torque equal to or larger than the predetermined value acts on the hydraulic actuator.

As described above, when the engine is being stopped if the reverse torque acting on the hydraulic actuator becomes equal to or larger than the predetermined value, the torque limiter mechanism is operated to limit the hydraulic pressure, so that an excessively large torque is not generated when the engine is stopped, and further large impact torque is prevented from being generated in the hydraulic actuator. Therefore it is possible to prevent the hydraulic actuator, the hydraulic pressure supply control valve, and the oil passage from being adversely affected by large impact torque.

Further preferably, the torque limiter mechanism is a relief valve arranged in the oil passage, for opening the oil passage when the hydraulic pressure in the oil passage becomes equal to or larger than a predetermined pressure corresponding to the reverse torque equal to or larger than the predetermined value.

According to this preferred embodiment, since the relief valve is arranged in the oil passage between the hydraulic actuator and the hydraulic pressure supply control valve, it is possible to open the oil passage by the relief valve to thereby relieve the hydraulic pressure. Therefore, generation of excessive hydraulic pressure within the oil passage can be prevented.

Alternatively, the torque limiter mechanism is a clutch arranged between the engine and the hydraulic actuator, for suppressing an increase in the reverse torque transmitted from the engine to the hydraulic actuator, when the reverse torque becomes equal to or larger than the predetermined value.

According to this preferred embodiment, the clutch is arranged between the engine and the hydraulic actuator, and when the reverse torque from the engine has become equal to or larger than the predetermined value, the clutch is operated to prevent the torque transmitted from the engine to the hydraulic actuator from being increased. This prevents excessive reverse torque from acting on the first rotational shaft of the hydraulic actuator, as well as resultant generation of excessive hydraulic pressure within the oil passage.

Preferably, the starter system further comprises a discharge oil passage for discharging the hydraulic pressure from the hydraulic actuator, and the hydraulic pressure supply control valve can open or close the oil passage and the discharge oil passage simultaneously.

According to this preferred embodiment, since it is possible to simultaneously open or close the oil passage, via which hydraulic pressure is supplied, and the discharge oil passage, it is possible to reduce time wasted before re-start of rotation of the hydraulic actuator when it is driven again.

The above and other objects, features, and advantages of the invention will become more apparent from the following detailed description taken in conjunction with the accompanying drawings.

DETAILED DESCRIPTION OF PREFERRED EMBODIMENTS

Figure 1:
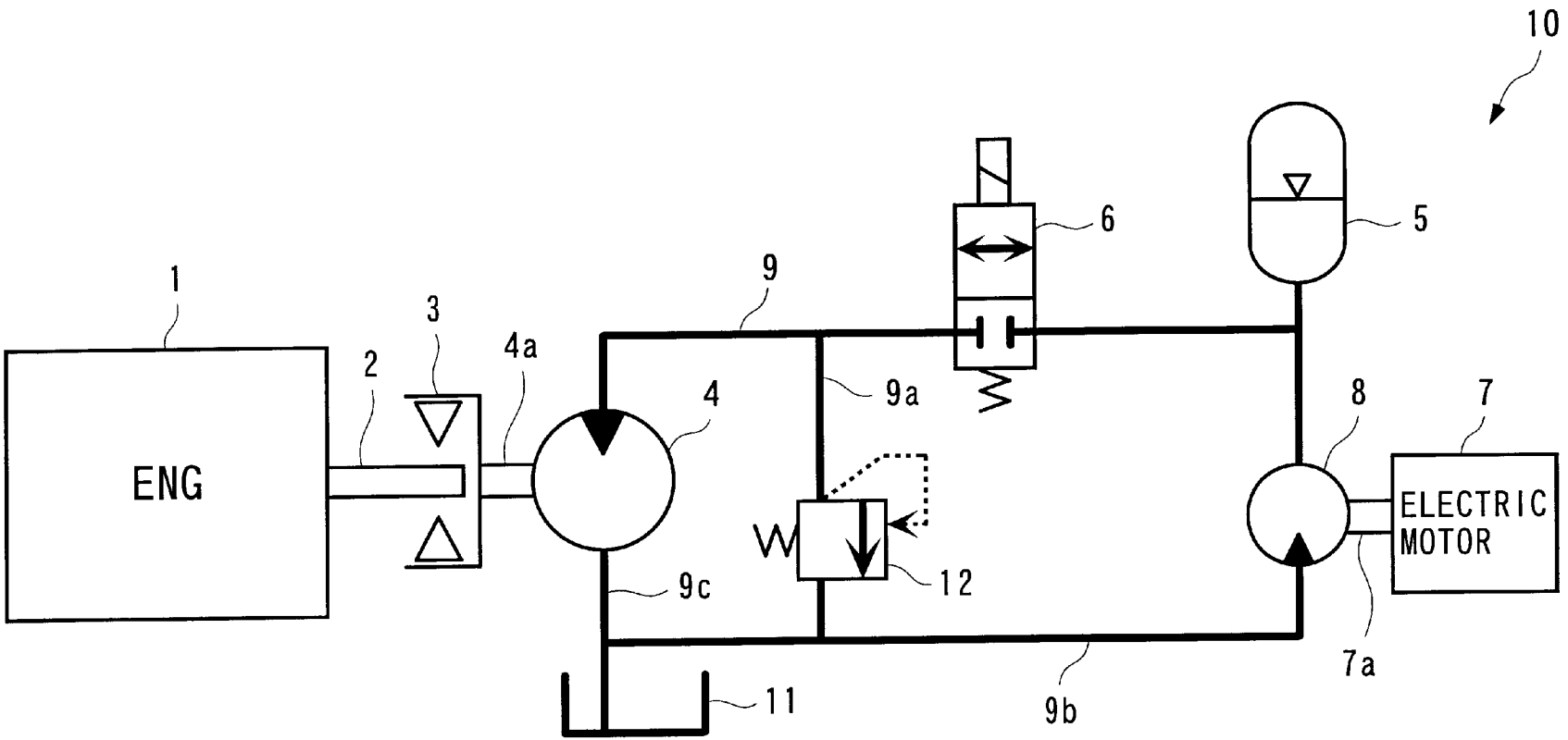
FIG. 1 is a diagram schematically showing the arrangement of a starter system for an internal combustion engine, according to a first embodiment of the invention.

The invention will now be described in detail with reference to the drawings showing preferred embodiments thereof. Referring first to FIG. 1, there is schematically shown the arrangement of a starter system for an internal combustion engine, according to a first embodiment of the invention. In the figure, reference numeral 1 designates the internal combustion engine (hereinafter simply referred to as "the engine") (ENG). The starting system 10 drives a crankshaft 2 of the engine 1 for rotation, whereby the engine 1 is started.

The starter system 10 is comprised of an electric motor 7, an oil pump 8 driven by the electric motor 7, an accumulator 5 for storing hydraulic pressure boosted by the oil pump 8, a hydraulic motor 4 (hydraulic actuator) connected to the accumulator 5 via an oil passage 9, a solenoid valve 6 (hydraulic pressure supply control valve) arranged in the oil passage 9, a relief valve 12 arranged in a branch oil passage 9*a* branching from the oil passage 9 to a reserve tank 11, and an ECU (Electronic Control Unit), not shown, for controlling operations of the hydraulic motor 4 and other devices.

The hydraulic motor 4 is a swash-plate type, for instance, and driven for rotation by hydraulic pressure supplied from the accumulator 5 via the oil passage 9 opened by the solenoid valve 6. A drive shaft 4*a* of the hydraulic motor 4 is connected to a crankshaft 2 via a one-way clutch 3. That is, the starter system 10 is a constant-mesh type in which the drive shaft 4*a* of the hydraulic motor 4 is in constant mesh with the crankshaft 2. The one-way clutch 3 allows transmission of rotation or torque from the drive shaft 4*a* to the crankshaft 2 only when the hydraulic motor 4 is driven by hydraulic pressure from the accumulator 5, whereas after the engine 1 has been started, the one-way clutch 3 inhibits transmission of rotation or torque from the crankshaft 2 to the hydraulic motor 4.

The oil pump 8 is directly connected to the drive shaft 7*a* of the electric motor 7, with a suction port thereof connected to the reserve tank 11 via a pump oil passage 9*b* and a discharge port thereof connected to the accumulator 5 via the oil passage 9. According to this construction, the oil pump 8 is driven by operation of the electric motor 7, and hydraulic pressure boosted by the oil pump 8 is supplied to the accumulator 5 via the oil passage 9 and accumulated therein.

The solenoid valve 6 arranged between the accumulator 5 and the hydraulic motor 4 is a normally-closed valve. More specifically, in a non-excited state, the solenoid valve 6 closes the oil passage 9, and when excited for starting the engine 1, it opens the oil passage 9 to allow the hydraulic pressure accumulated in the accumulator 5 to be supplied to the hydraulic motor 4. Hydraulic fluid or oil supplied to the hydraulic motor 4 is returned to the reserve tank 11 via a discharge oil passage 9*c*. On the other hand, the relief valve 12 opens the branch oil passage 9*a* when hydraulic pressure within the oil passage 9 becomes equal to or higher than a predetermined pressure level, to thereby return the hydraulic fluid to the reserve tank 11 so as to relieve hydraulic pressure in the oil passage 9. The predetermined pressure level is set to be higher than a pressure level required for causing operation of the hydraulic motor 4, whereby operation of the relief valve 12 is inhibited from operating during normal use. Further, the predetermined pressure level is set to a level corresponding to that of a hydraulic pressure generated in the oil passage 9 by action of a reverse torque from the engine 1 when the reverse torque is equal to or larger than a predetermined value.

Next, the operation of the starter system 10 constructed as above will be described. When the engine 1 is to be started, the solenoid valve 6 is excited to open the oil passage 9. As a result, hydraulic pressure is supplied from the accumulator 5 to the hydraulic motor 4, whereby the hydraulic motor 4 is driven for rotation. Then, the torque of the drive shaft 4*a* of the hydraulic motor 4 is transmitted to the crankshaft 2 via the one-way clutch 3 to start the engine 1.

When the crankshaft 2 is rotated in the reverse direction by a reaction force generated from the engine 1 due to failure in starting the same, reverse torque acting in a direction opposite to the direction of torque for starting the engine 1 is transmitted to the drive shaft 4*a* of the hydraulic motor 4, whereby the drive shaft 4*a* performs reverse rotation. This causes the hydraulic motor 4 to act as a hydraulic pump, which increases hydraulic pressure within the oil passage 9. Then, when the hydraulic pressure becomes equal to or higher than the predetermined value, the branch oil passage 9*a* is opened by the relief valve 12, which allows hydraulic pressure to be relived thereby preventing the hydraulic pressure within the oil passage 9 from getting even higher. Similarly, during stopping process of the engine 1, when a hydraulic pressure equal to or higher than the predetermined pressure level is generated within the closed oil passage 9 between the hydraulic motor 4 and the solenoid valve 6 by reverse torque acting on the hydraulic motor 4 for the same reason as above, it is possible to open the branch oil passage 9*a* by the relief valve 12, thereby relieve the hydraulic pressure in the oil passage 9.

As described above, according to the present embodiment, when reverse torque equal to or higher than the predetermined value acts on the hydraulic motor 4 immediately before stoppage of the engine 1 or immediately after failure in starting the same to generate a hydraulic pressure equal to or higher than the predetermined pressure level within the oil passage 9, the hydraulic pressure is relieved from the oil passage 9 by the relief valve 12, so that it is possible to prevent generation of excessively high hydraulic pressure within the oil passage 9 and hence generation of impact torque in the hydraulic motor 4. As a result, it is possible to prevent the hydraulic motor 4, the solenoid valve 6, the oil passage 9, and so forth from being adversely affected by excessively high hydraulic pressure or large impact torque.

Figure 2:
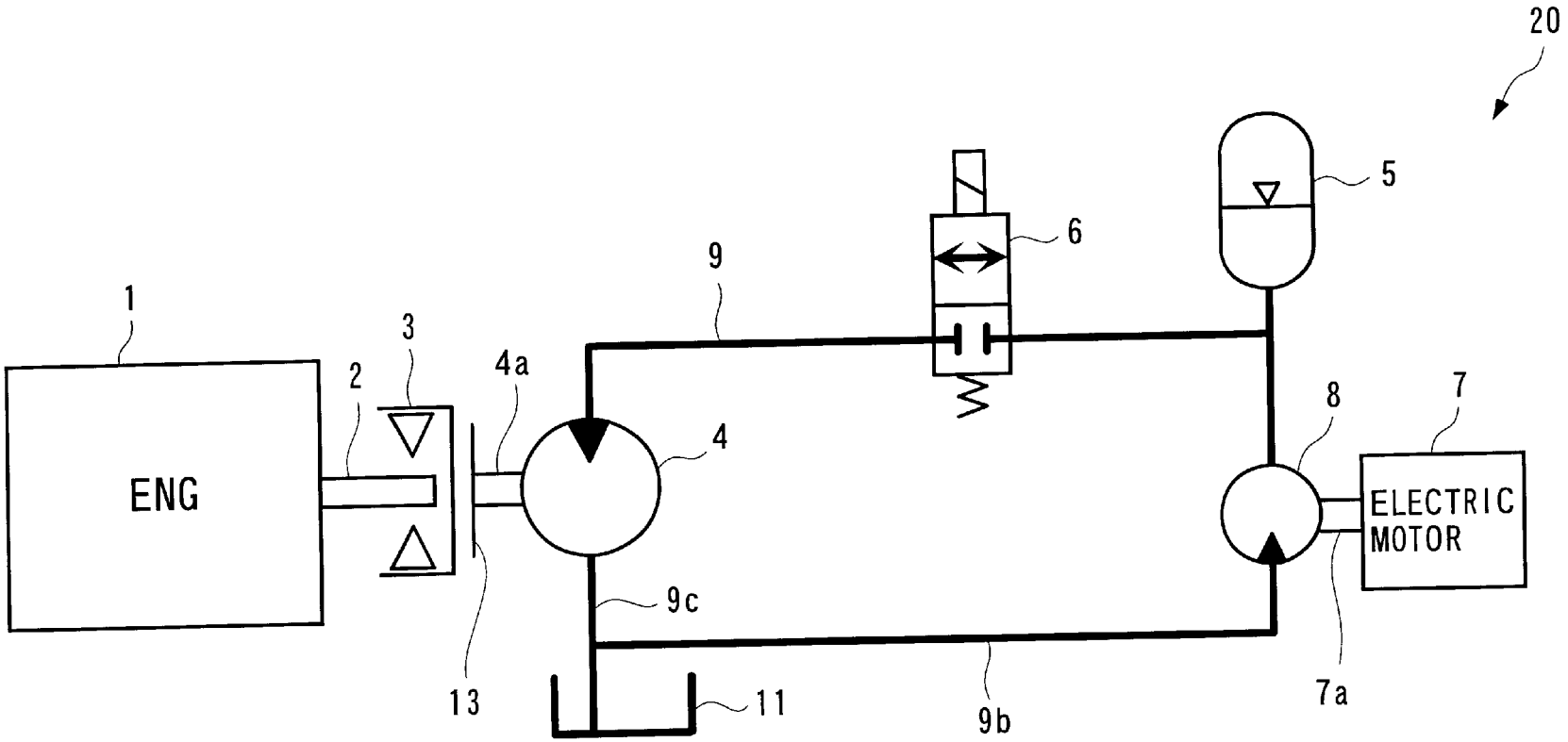
FIG. 2 is a diagram schematically showing the arrangement of a starter system for an internal combustion engine, according to a second embodiment of the invention.

FIG. 2 schematically shows the arrangement of a starter system according to a second embodiment of the invention.

It should be noted that in the following description, component parts and elements similar or equivalent to those of the first embodiment are designated by identical reference numerals, and detailed description thereof is omitted when deemed proper. This starter system 20 is distinguished from the starter system 10 of the first embodiment in that it has a torque limiter mechanism formed by a clutch 13 arranged between the engine 1 and the hydraulic motor 4, in place of the relief valve 12. The clutch 13 slips when reverse torque generated from the engine 1 and acting on the hydraulic motor 4 becomes equal to or larger than a predetermined value, so as to prevent transmission of a larger reverse torque than the predetermined value. The second embodiment is similar in construction to the first embodiment except for the above torque limiter mechanism.

As described above, according to the starter system 20 of the present embodiment, when the reverse torque generated from the engine 1 becomes equal to or larger than the predetermined value immediately after stoppage of the engine 1 or failure in starting the same, the clutch 13 slips to relieve the reverse torque. This makes it possible to prevent excessively large reverse torque from acting on the drive shaft 4*a* of the hydraulic motor 4 as well as to prevent generation of excessively high hydraulic pressure within the oil passage 9. Thus, the second embodiment can provide the same advantageous effects as obtained from the above first embodiment.

Figure 3:
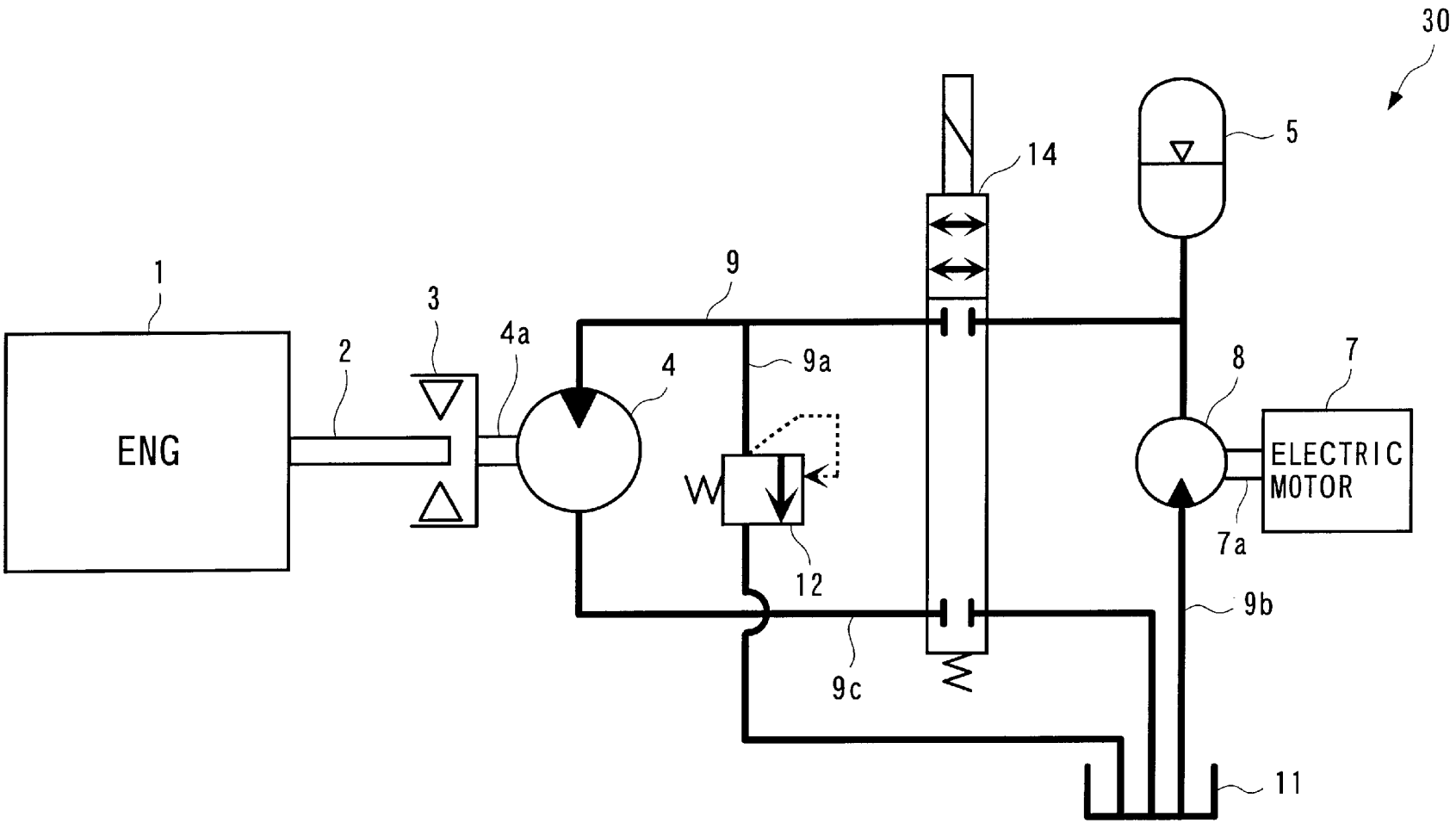
FIG. 3 is a diagram schematically showing the arrangement of a starter system for an internal combustion engine, according to a third embodiment of the invention.

FIG. 3 schematically shows the arrangement of a starter system according to a third embodiment of the invention. As shown in the figure, the starter system 30 of the present embodiment is distinguished from the starter system 10 of the first embodiment in which the solenoid valve 6 opens and closes only the oil passage 9 through which hydraulic pressure is supplied, in that there is provided a solenoid valve 14 which is capable of opening or closing the oil passage 9 and the discharge oil passage 9*c* simultaneously. The third embodiment is similar in construction to the first embodiment except for the above solenoid valve 14. Therefore, the third embodiment can provide the same advantageous effects as obtained from the above first embodiment. Further, since the oil passage 9 and the discharge oil passage 9*c* can be held in respective closed states simultaneously, it is possible to reduce time wasted before re-start of rotation of the hydraulic motor 4 when it is driven again.

Figure 4:
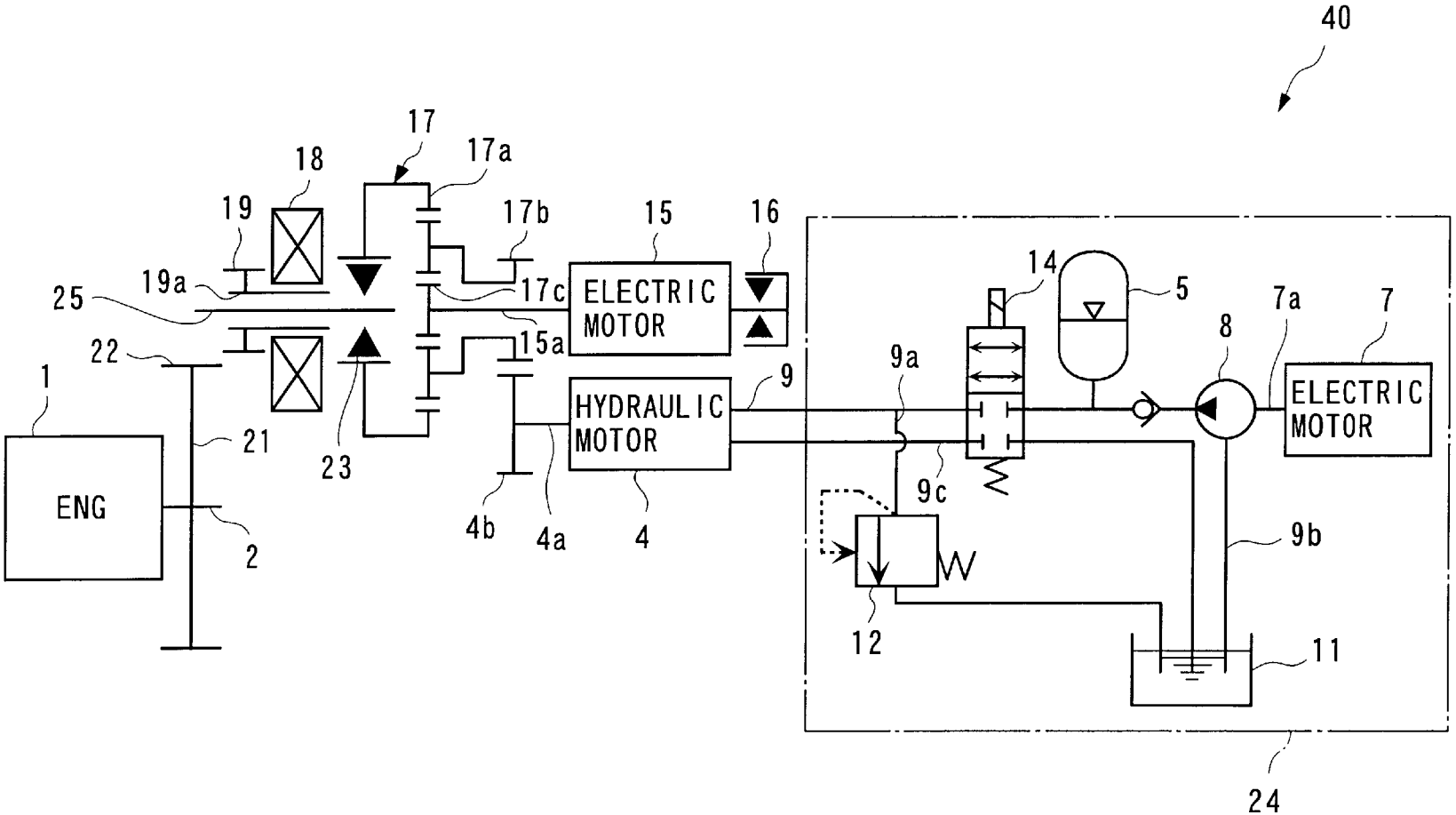
FIG. 4 is a diagram schematically showing a variation of the third embodiment.

FIG. 4 schematically shows the arrangement of a variation of the third embodiment. In the following description as well, component parts and elements similar or equivalent to those of the first embodiment are designated by identical reference numerals, and detailed description thereof is omitted when deemed proper. As shown in the figure, the starter system 40 is distinguished from the FIG. 3 starter system 30 of the constant-mesh type, in that it is a plunging-type which starts the engine 1 by causing a pinion gear 19 to plunge into a ring gear 22 integrally formed with the crankshaft 2 of the engine 1. Further, the starter system 30 uses the hydraulic motor 4 and an electric motor 15 in combination. The driving forces from the motors 4, 15 are selectively transmitted to the engine 1 via a planetary gear set 17 to thereby start the engine 1.

The pinion gear 19 is fitted on an output shaft 25 such that it can move axially and rotate in unison with the output shaft 25, and axially driven by a magnet switch 18 when the engine 1 is started. The drive shaft 4*a* of the hydraulic motor 4 extends in parallel with the output shaft 25 and is connected to the output shaft 25 via an output gear 4*b* integrally formed with the drive shaft 4*a*, a carrier 17*b* of the planetary gear set 17, a ring gear 17*a*, and a one-way clutch 23. Further, a drive shaft 15*a* of the electric motor 15 is arranged such that it extends coaxially with the output shaft 25, and fixed to a sun gear 17*c* of the planetary gear set 17 and also connected to the output shaft 25 via the carrier 17*b*, the ring gear 17*a*, and the one-way clutch 23. The starter system 40 has the same construction as the FIG. 3 starter system except for the above points.

When the engine 1 is to be started by the hydraulic motor 4, the magnet switch 18 is driven to bring the pinion gear 19 into meshing engagement with the ring gear 22, and at the same time the hydraulic motor 4 is driven for rotation by hydraulic pressure supplied from a hydraulic motor-driving mechanism 24. The rotation of the hydraulic motor 4 is transmitted to the ring gear 22 via the planetary gear set 17, the pinion gear 19, and so forth, whereby the engine 1 is started. At this time, the drive shaft 15*a* of the electric motor 15 is locked by a one-way clutch 16, so that the sun gear 17*c* is fixed held immovable.

On the other hand, when the engine 1 is to be started by the electric motor 15, the oil passage 9, via which hydraulic pressure is supplied to the hydraulic motor 4, and the discharge oil passage 9*c* are closed by the solenoid valve 14 simultaneously to completely cut off the flow of hydraulic fluid, whereby the drive shaft 4*a* of the hydraulic motor 4 is locked, so that the carrier 17*b* is fixed or made immovable. Thereafter, the same sequence of operations as carried out in the above case of using the hydraulic motor 4 is carried out, whereby the engine 1 is started by the electric motor 15.

According to the above variation, when the crankshaft 2 is caused to perform reverse rotation by a reaction force generated from the engine 1 due to failure in starting the same, reverse torque generated by the reverse rotation of the crankshaft 2 is transmitted to the drive shaft 4*a* of the hydraulic motor 4 via the ring gear 22, the pinion gear 19, the one-way clutch 23, and the carrier 17*b* of the planetary gear set 17 to cause reverse rotation of the drive shaft 4*a*. As a result, the hydraulic motor 4 acts as a hydraulic pump to increase hydraulic pressure within the oil passage 9. Particularly when the start of the engine 1 by the electric motor 15 fails, since the oil passage 9 and the discharge oil passage 9*c* are each held in a closed state by the solenoid valve 14, an excessively high hydraulic pressure is likely to be generated within the closed oil passage 9. However, in the present variation, similarly to the above embodiment, when the hydraulic pressure within the oil passage 9 becomes equal to or higher than the predetermined pressure level, it is possible to open the branch oil passage 9*a* by the relief valve 12 to thereby relieve the hydraulic pressure, and hence generation of the excessively high hydraulic pressure can be prevented.

As described above, according to the starter system 40, in which the electric motor 15 and the hydraulic motor 4 are selectively operated by using the plunging mechanism and the planetary gear set 17, the operation of the relief valve 17 provides the same effects as obtained by the third embodiment.

Although in the second embodiment, when the reverse torque equal to or larger than the predetermined value acts on the hydraulic motor 4, the clutch 13 is caused to slip to prevent the reverse torque from being further increased, this is not limitative, but in this case, the clutch may be disengaged.

Figure 5:
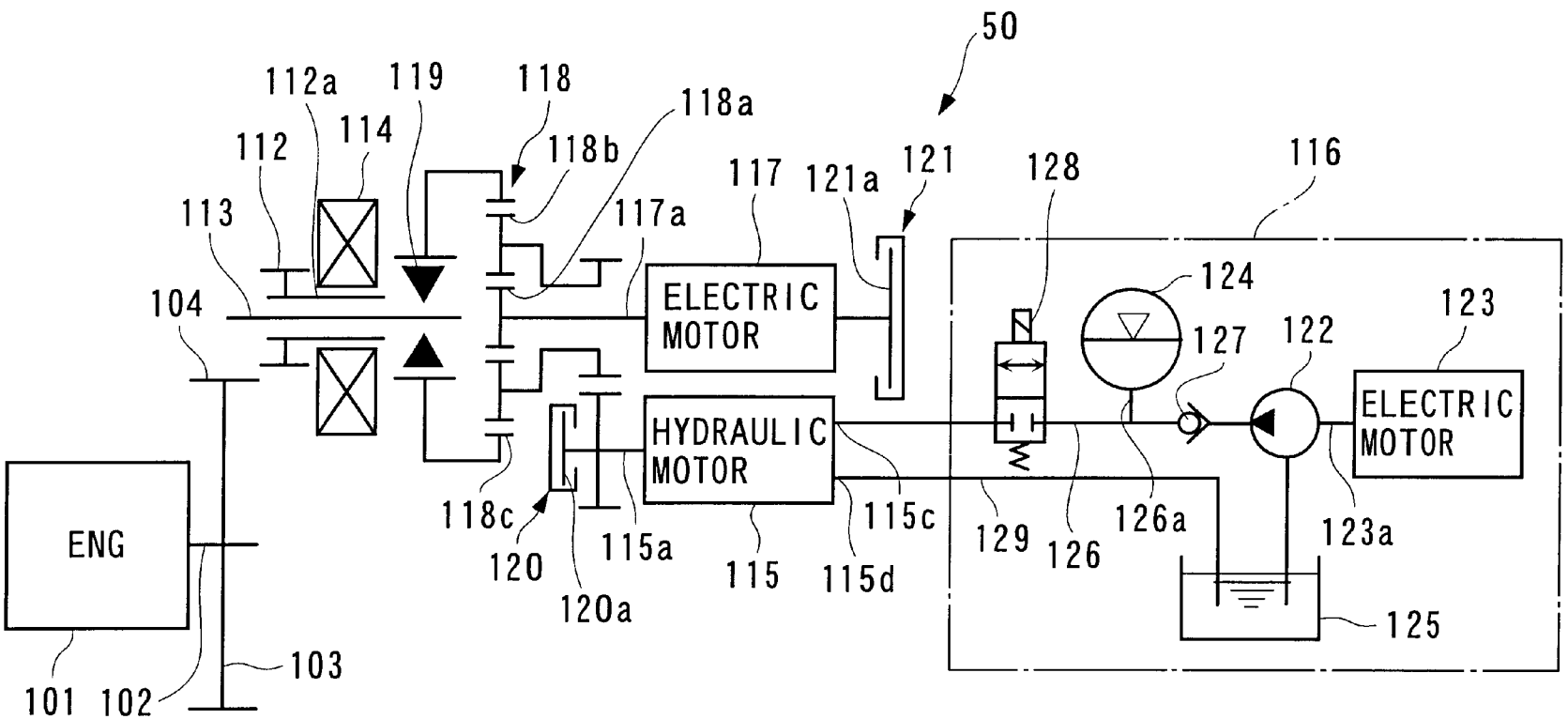
FIG. 5 is a diagram schematically showing the arrangement of a starter system for an internal combustion engine, according to a fourth embodiment of the invention.

Next, a fourth embodiment of the invention will be described. FIG. 5 schematically shows the arrangement of a starter system of the present embodiment. The engine 101 has a crankshaft 102 on which a flywheel 103 is rigidly fitted. The flywheel 103 has a ring gear 104*a* integrally formed around a peripheral surface thereof.

The starter system 50 includes the ring gear 104 (driven gear), a pinion gear 112 (driving gear) fitted on an output shaft 113, a magnet switch 114 for moving the pinion gear 112 toward the ring gear 104 when the engine is started so as to bring the pinion gear 112 into meshing engagement with the ring gear 104, a hydraulic motor 115 (hydraulic actuator) for driving the pinion gear 112 for rotation when the engine 1 is started, a hydraulic motor-driving mechanism 116 for driving the hydraulic motor 115, an electric motor 117 for auxiliary drive, a planetary gear set 118 for transmitting respective driving forces from the hydraulic motor 115 and the electric motor 117 to the output shaft 113, and an ECU, not shown, for controlling operations of the hydraulic motor 115 and other devices.

The pinion gear 112 is formed by a helical gear meshable with the ring gear 104. The pinion gear 112 is rigidly fitted on one end of a pinion shaft 112*a* which is coaxially splined to the output shaft 113, whereby the pinion gear 112 can rotate in unison with the output shaft 113 and move in the axial direction.

The planetary gear set 118 is comprised of a sun gear 118*a*, a carrier 118*b*, and a ring gear 118*c*, and the three gears 118*a*, 118*b*, 118*c* are set to predetermined gear ratios. The output shaft 113 is connected to the ring gear 118*c* of the planetary gear set 118 via a one-way clutch 119. The one-way clutch 119 allows transmission of torque only when the ring gear 118*c* drives the output shaft 113 in the direction for starting the engine 101, whereas when the output shaft 113 is caused to rotate reversely, the clutch 119 cuts off the torque.

The magnet switch 114 is formed by a solenoid including a plunger, an exciting coil, and a return spring, none of which are shown. When the magnet switch 114 is in a non-excited state, the pinion gear 112 is held in a non-engagement position (i.e. a state shown in FIG. 5) where the pinion gear 112 is inhibited from meshing with the ring gear 104. On the other hand, when the magnet switch 114 is excited, the plunger is caused to project to move the pinion shaft 112*a* toward the engine 101, whereby the pinion gear 112 is displaced to an engagement position, not shown, for meshing engagement with the ring gear 104.

A rotational shaft 115*a* of the hydraulic motor 115 extends in parallel with the output shaft 113, and is connected to the carrier 118*b* of the planetary gear set 118. Further, the rotational shaft 115*a* is provided with a hydraulic motor brake 120 (second fixing means). The hydraulic motor brake 120 has a disk shape, and mechanically locks the rotational shaft 115*a* by sandwiching a disk rotor 120*a*, which rotates in unison with the rotational shaft 115*a*, between pads, not shown, by hydraulic pressure, to thereby fix the carrier 118*b* of the planetary gear set 118 connected to the rotational shaft 115*a*.

On the other hand, the electric motor 117 drives the pinion gear 112 for rotation in place of the hydraulic motor 115 to start the engine 101 auxiliarily, e.g. when the engine 101 is in a very low-temperature condition. A rotational shaft 117*a* of the electric motor 117 extends coaxially with the output shaft 113, and is connected to the sun gear 118*a* of the planetary gear set 118. The rotational shaft 117*a* also protrudes from the electric motor 117 in the direction away from the planetary gear set 118, and has an electric motor brake 121 (first fixing means) provided at an end thereof. Similarly to the hydraulic motor brake 20, the electric motor brake 121 has a disk shape, and mechanically locks the rotational shaft 117*a* by sandwiching a disk rotor 121*a* integrally formed with the rotational shaft 117*a*, between pads, not shown, to thereby fix the sun gear 118*a* of the planetary gear set 118.

The hydraulic motor-driving mechanism 116 includes an oil pump 122, an electric motor 123 for driving the oil pump 122 for pressure accumulation, and an accumulator 124 for accumulating hydraulic pressure boosted by the oil pump 122. The oil pump 122 is directly connected to a rotational shaft 123*a* of the electric motor 123, with a suction port thereof connected to a reserve tank 125 and a discharge port thereof connected to an inlet port 115*c* of the hydraulic motor 115 via an oil passage 126 provided with a check valve 127. A branch passage 126*a* branches from a portion of the oil passage 126 at a location downstream of the check valve 127. The accumulator 124 is arranged in the branch passage 126*a*. According to the construction described above, when the electric motor 123 is operated, the oil pump 122 is driven thereby to boost hydraulic pressure and supply the boosted hydraulic pressure to the accumulator 124 via the check valve 127, whereby the hydraulic pressure is accumulated in the accumulator 124.

Further, the oil passage 126 has a solenoid valve 128 arranged therein at a location between the accumulator 124 and the hydraulic motor 115. The solenoid valve 128 is a normally-closed type. More specifically, in a non-excited state, the solenoid valve 128 closes the oil passage 126, and whereas when excited, it opens the oil passage 126 to allow the hydraulic pressure accumulated in the accumulator 124 to be supplied to the hydraulic motor 115. Oil supplied to the hydraulic motor 115 is returned to the reserve tank 125 via a discharge port 115*d* of the hydraulic motor 115 and a return oil passage 129.

The respective operations of the magnet switch 114, the electric motors 117, 123, the hydraulic motor brake 120, the electric motor brake 121, and the solenoid valve 128 are controlled by drive signals from the ECU in response to an operating status of an ignition key, not shown, and the like.

Next, the operation of the starter system 50 constructed as above will be described. First, when the engine 101 is in operation, the solenoid valve 128 is held in a non-excited state, and the electric motor 123 is driven under predetermined conditions to operate the oil pump 122, whereby hydraulic pressure boosted by the oil pump 122 is accumulated in the accumulator 124. After stoppage of the engine 101, the hydraulic pressure stored in the accumulator 124 is preserved by the check valve 127.

When the engine 101 is to be started by the hydraulic motor 115, the magnet switch 114 is driven to shift the pinion gear 112 to the engagement position for meshing engagement with the ring gear 104, and at the same time the solenoid valve 128 is excited to open the oil passage 126. This allows the hydraulic pressure to be supplied from the accumulator 124 to the hydraulic motor 115 to drive the same for rotation. Further, simultaneously with the above control operation, the electric motor brake 121 is driven to lock the rotational shaft 117*a* of the electric motor 117. This causes the sun gear 118*a* of the planetary gear set 118 connected to the rotational shaft 117*a* to be made immovable, and at the same time the rotation of the rotational shaft 115*a* of the hydraulic motor 115 is transmitted from the carrier 118*b* to the ring gear 118*c* at an increased rotational speed increased at an overdrive ratio corresponding to the gear ratio of the planetary gear set 118.

The rotation or torque of the ring gear 118*c* is transmitted to the output shaft 113 via the one-way clutch 119, and then transmitted to the ring gear 104 via the pinion gear 112, whereby the engine 101 is started. After the engine 101 has been started and the rotational speed of the ring gear 104 has risen to exceed that of the pinion gear 112, the one-way clutch 119 operates to cause the output shaft 113 to perform idle or free rotation, so that torque from the engine 101 is transmitted neither to the ring gear 118*c* nor to the hydraulic motor 115.

On the other hand, when the electric motor 117 is used to start the engine 101, the magnet switch 114 and the electric motor 117 are driven with the solenoid valve 128 held in the non-excited state, and at the same time the hydraulic motor brake 120 is driven to lock the rotational shaft 115*a* of the hydraulic motor 115. As a result, the carrier 118*b* of the planetary gear set 118 connected to the rotational shaft 115*a* is made immovable, and at the same time, the rotation of the rotational shaft 117*a* of the electric motor 117 is transmitted from the sun gear 118*a* to the ring gear 118*c* at a reduced rotational speed reduced at a reduction ratio corresponding to the gear ratio of the planetary gear set 118. Thereafter, similarly to the above case of the hydraulic motor 115 being used to start the engine 101, the torque of the ring gear 118*c* is transmitted to the ring gear 104 via the one-way clutch 119, the output shaft 113 and the pinion gear 112, whereby the engine 101 is started. After the engine 101 has been started, torque from the engine 101 is cut off by the one-way clutch 119, but transmitted neither to the ring gear 118*c* nor to the hydraulic motor 115.

As described above, according to the present embodiment, respective driving forces of the hydraulic motor 115 and the electric motor 117 can be selectively output to the output shaft 113 via the planetary gear set 118 without interference between the motors, at the respective overdrive and reduction ratios. In short, the planetary gear set 118 functions not only as a driving force-transmitting mechanism, but also as an overdrive/reduction mechanism for the hydraulic motor 115 and the electric motor 117, and hence it is possible to manufacture the starter system 50 compact in size at a reduced cost. Further, since the output shaft 113 is connected to the ring gear 118*c* of the planetary gear set 118, the electric motor 117 to the sun gear 118*a*, and the hydraulic motor 115 to the carrier 118*b*, torque from the electric motor 117 can be transmitted to the output shaft 113 at a reduced rotational speed, while torque from the hydraulic motor 115 can be transmitted to the same at an increased rotational speed. Therefore, the starter system 50 can be easily selectively placed in respective operative statuses in which the rotational speed of the output shaft is increased and decreased, in a manner adapted to the respective torque characteristics of the hydraulic motor 115 and the electric motor 117.

Further, the switching between outputs of the respective driving forces of the electric motor 117 and the hydraulic motor 115 can be carried out easily and reliably by mechanically locking the rotational shaft 115*a* of the hydraulic motor 115 by the hydraulic motor brake 120 or the rotational shaft 117*a* of the electric motor 117 by the electric motor brake 121, and thereby making immovable the carrier 118*b* or the sun gear 118*a*.

Figure 6:
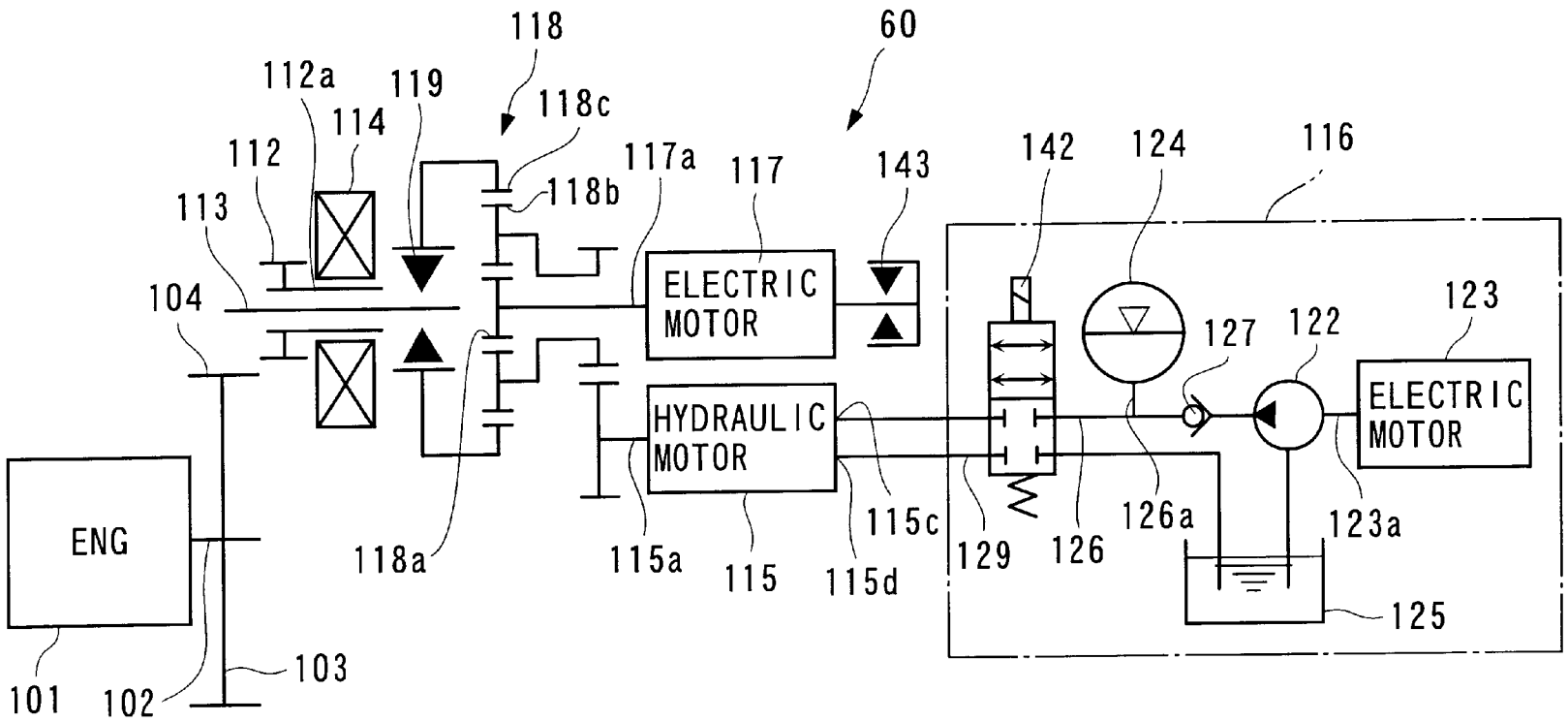
FIG. 6 is a diagram schematically showing a variation of the fourth embodiment.

FIG. 6 shows a variation of the fourth embodiment. It should be noted that in the following description, component parts and elements similar or equivalent to those of the fourth embodiment are designated by identical reference numerals, and detailed description thereof is omitted when deemed proper. As shown in the figure, the starter system 60 is distinguished from the starter system 50 of the fourth embodiment in that it has a solenoid switch valve 142 (second fixing means) in place of the hydraulic motor brake 120 and the solenoid valve 128, and that it has a one-way clutch 143 (first fixing means) mounted to the rotational shaft 117*a* of the electric motor 117 in place of the electric motor brake 121. The present variation is similar in construction to the fourth embodiment except for the above points.

The solenoid switch valve 142 is a normally-closed type which is arranged in respective intermediate portions of the oil passage 126 and the return oil passage 129 such that the two oil passages 126 and 129 extend through the solenoid switch valve 142. In a non-excited state, the solenoid switch valve 142 closes the oil passages 126 and 129 simultaneously, while in an excited state, it opens the oil passages 126 and 129 simultaneously. The one-way clutch 143 performs idle or free rotation when the electric motor 117 is driven in the direction for starting the engine 101, whereas when the electric motor 117 is caused to perform reverse rotation, the one-way clutch 143 locks the rotational shaft 117*a*.

The starter system 60 starts the engine 1 by the following starting operations: When the engine 101 is to be started by the hydraulic motor 115, the magnet switch 114 is driven, and at the same time the solenoid switch valve 142 is excited to open the oil passage 126 and the return oil passage 129. As a result, hydraulic pressure is supplied from the accumulator 124 via the oil passage 126, whereby the hydraulic motor 115 is driven for rotation. At this time, the rotational shaft 117*a* of the electric motor 117 is locked by the one-way clutch 143, whereby the sun gear 118*a* is fixed or made immovable. Thereafter, the starter system 60 operates similarly to the starter system 50 of the fourth embodiment, whereby the engine 101 is started by the hydraulic motor 115.

On the other hand, when the engine 101 is to be started by the electric motor 117, the electric motor 117 is driven, with the solenoid switch valve 142 held in the non-excited state. As a result, the oil passage 126 and the return oil passage 129 are both closed simultaneously, and the flows of oil in the two oil passages 126, 129 are cut off completely. This causes the rotational shaft 115*a* of the hydraulic motor 115 to be locked, whereby the carrier 118*b* is fixed or made immovable. Thereafter, the starter system 60 operates similarly to the starter system 50 of the fourth embodiment, whereby the engine 101 is started by the electric motor 117.

As described above, according to the starter system 60, since the electric motor brake 121 in the fourth embodiment is replaced by the one-way clutch 143, control of the electric motor brake 121 by the ECU can be dispensed with, which makes it possible to simplify the control system. Further, it is possible to substitute the solenoid switch valve 142 for the solenoid valve 128 in the fourth embodiment, and dispense with the hydraulic motor brake 120 at the same time, which contributes to further reduction of the size and manufacturing costs of the starter system.

Although not shown, the hydraulic motor brake 120 may also be replaced by a one-way clutch. Further, the electric motor 117 may be electrically locked, whereby the electric motor brake 121 and the one-way clutch 143 may be omitted.

Figure 7:
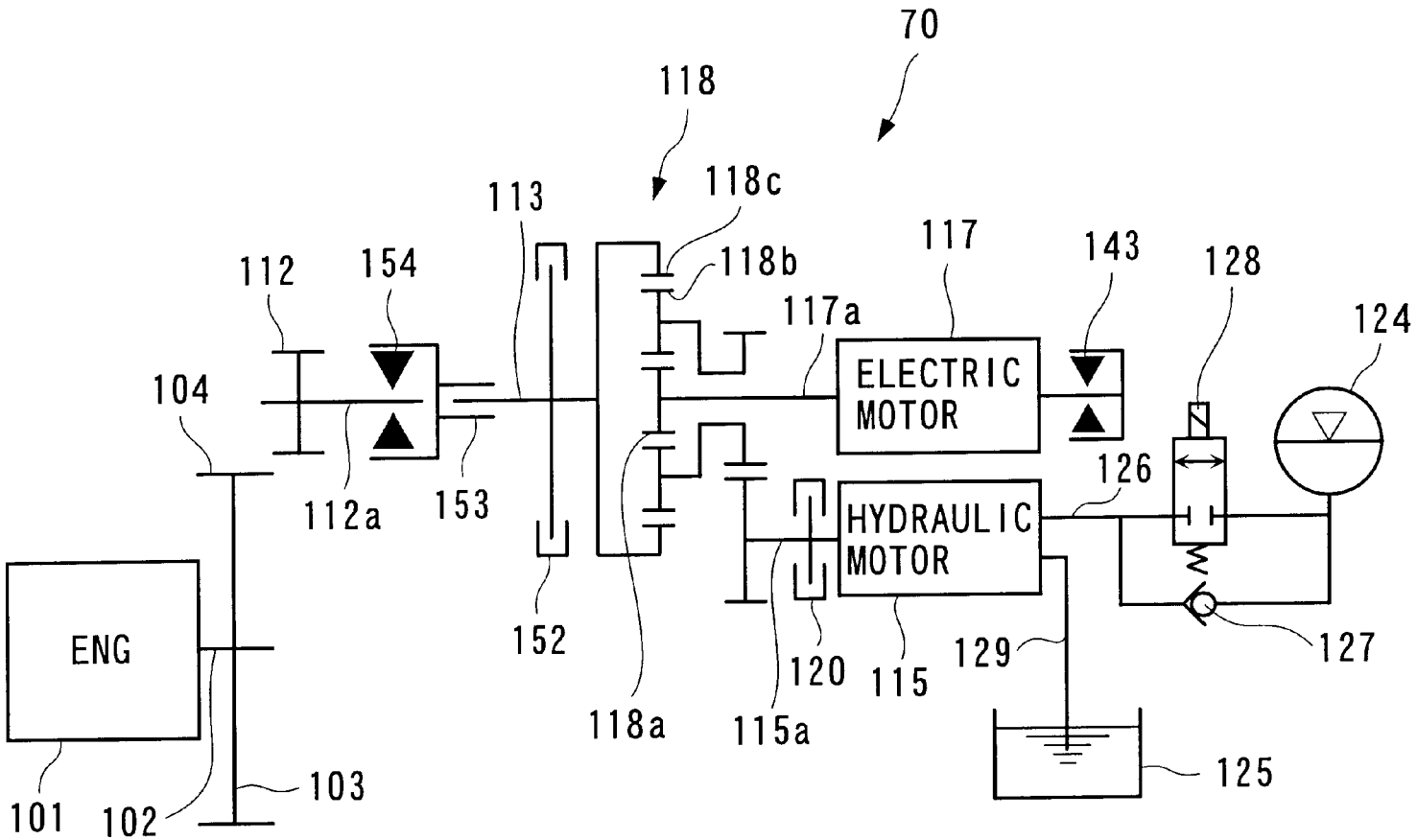
FIG. 7 is a diagram schematically showing the arrangement of a starter system for an internal combustion engine, according to a fifth embodiment of the invention.

FIG. 7 schematically shows the arrangement of a starter system according to a fifth embodiment of the invention. As shown in the figure, in the starter system 70 of the present embodiment, the check valve 127 and the solenoid valve 128 are arranged in parallel with each other in an intermediate portion of the oil passage 126, and the oil pump 122 and the electric motor 123 in the fourth embodiment are omitted. The output shaft 113 is provided with an output shaft brake 152 (third fixing means). Similarly to the FIG. 6 variation, the electric motor 117 is provided with the one-way clutch 143 in place of the electric motor brake 121.

The output shaft 113 is connected to the pinion shaft 112*a* via a helical spline 153, and a one-way clutch 154 for prevention of overrun, and the magnet switch 114 in the fourth embodiment is omitted. More specifically, in this plunging mechanism, when the output shaft 113 is driven for rotation at the start of the engine, the helical spline 153 displaces the pinion shaft 112*a* to bring the pinion gear 112 into meshing engagement with the ring gear 104. Except during the start of the engine, the pinion gear 112 is always held in the non-engagement position (i.e. a state shown in FIG. 7) by a return spring, not shown. The one-way clutch 154 is provided for preventing overrun of the output shaft 113 after the start of the engine 101. The fifth embodiment is similar in construction to the fourth embodiment except for the above points.

The operation of the starter system 70 is as follows. First, when the engine 101 is to be started by the hydraulic motor 115, the solenoid valve 128 is excited. As a result, the hydraulic motor 115 is driven, and torque therefrom is transmitted to the output shaft 113 via the planetary gear set 118 with its sun gear 118*a* being fixed by the one-way clutch 154, and at the same time the pinion gear 112 is brought into meshing engagement with the ring gear 104 as described above, whereby the engine 101 is started. On the other hand, when the engine 101 is to be started by the electric motor 117, the electric motor 117 is driven with the solenoid valve 128 held in the non-excited state, and the hydraulic motor brake 120 is driven at the same time. As a result, the carrier 118*b* is fixed or made immovable, and torque from the electric motor 117 is transmitted to the output shaft 113 via the planetary gear set 118, whereby the engine 101 is started.

Further, when hydraulic pressure is to be accumulated in the accumulator 124, the electric motor 117 is driven with the solenoid valve 128 held in the non-excited state, and the output shaft brake 152 is driven at the same time. This causes the output shaft 113 to be locked, and the ring gear 118*c* of the planetary gear set 118 to be fixed or made immovable, whereby torque from the electric motor 117 is transmitted to the hydraulic motor 115 via the sun gear 118*a* and the carrier 118*b* to cause the rotational shaft 115*a* of the hydraulic motor 115 to rotate in a direction opposite to that of rotation thereof for starting the engine. As a result, hydraulic pressure boosted by the reverse rotation of the hydraulic motor 115 is supplied via the inlet port 115*c*, the oil passage 126 and the check valve 127 to the accumulator 124, and accumulated therein.

As described above, according to the starter system 70 of the present embodiment, it is possible to accumulate hydraulic pressure in the accumulator 124 by driving the electric motor 117 in the state of the ring gear 118*c* of the planetary gear set 118 being fixed by the output shaft brake 152, and thereby causing the hydraulic motor 115 to rotate in the direction opposite to that of rotation thereof for starting the engine. As a result, the oil pump 122 and the electric motor 123 used for pressure accumulation in the fourth embodiment can be omitted, which contributes to further reduction of the size and manufacturing costs of the starter system.

Although not shown, a one-way clutch may be employed as third fixing means for locking the output shaft 113, in place of the output shaft brake 152, or alternatively, the spring force of the return spring of the plunging mechanism may be utilized to cause engaging means, such as a dog clutch, to be engaged with the output shaft 113 to thereby lock the same. This makes it possible to lock the output shaft 113 without executing electrical control. Further, it is also possible to use the solenoid switch valve used in the FIG. 6 variation for opening/closing the oil passage 126 and the return oil passage 129 simultaneously, in place of the hydraulic motor brake 120, to lock the hydraulic motor 115. Moreover, another type of fixing means may be employed in place of the one-way clutch 143 in the fifth embodiment so as to use the hydraulic motor 115 as an oil pump. In this case, the hydraulic motor 115 may be formed by a swash plate motor equipped with a rotation-reversing mechanism, and the electric motor 123 is caused to rotate in a direction opposite to that of rotation thereof for starting the engine, to thereby cause the hydraulic motor 115 to rotate in the same direction as it rotates at the start of the engine.

Figure 8:
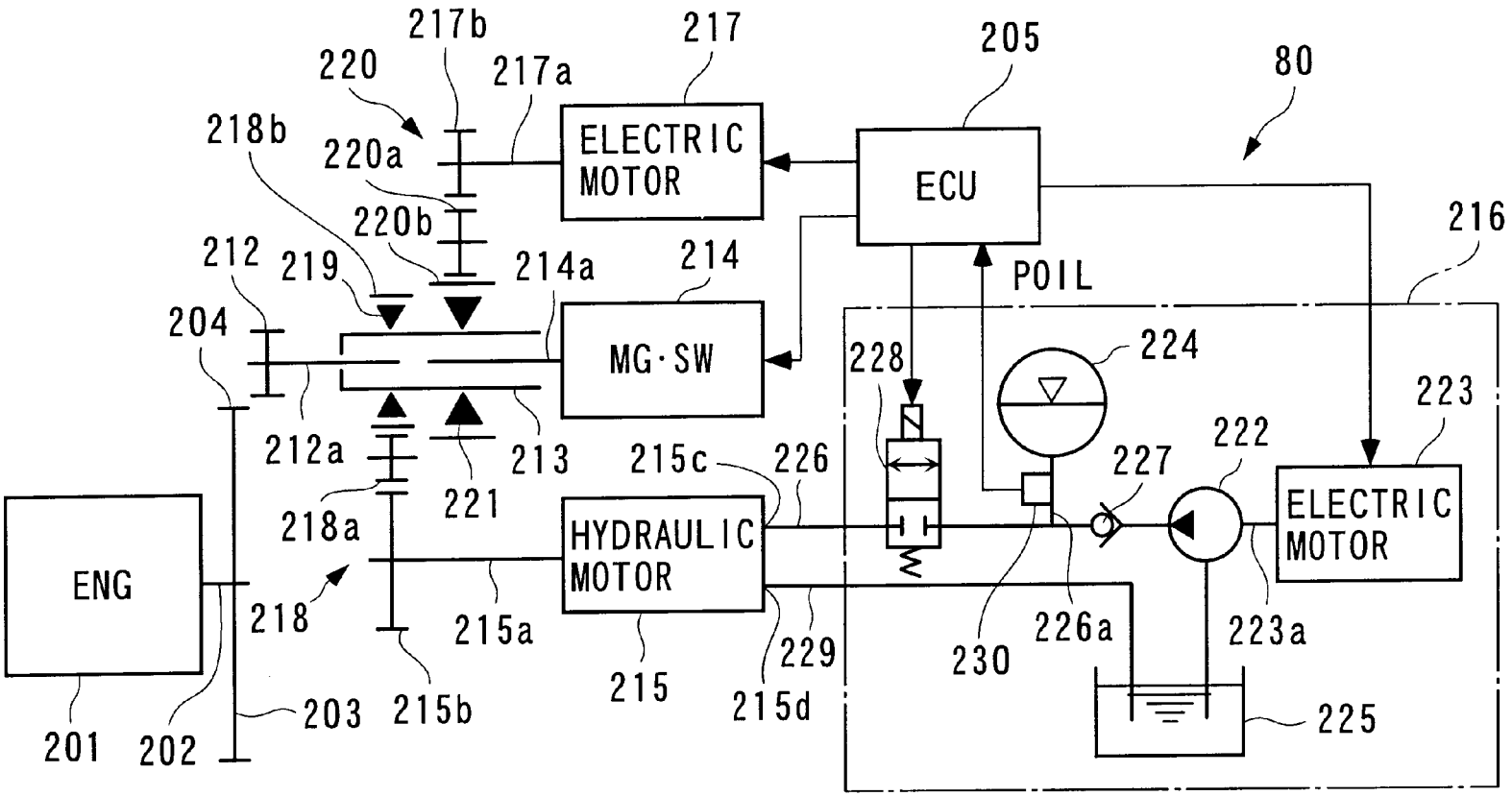
FIG. 8 is a diagram schematically showing the arrangement of a starter system for an internal combustion engine, according to a sixth embodiment of the invention.

Next, a sixth embodiment of the invention will be described. FIG. 8 schematically shows the arrangement of a starter system of the present embodiment. Reference numeral 201 designates an engine (ENG). The engine 201 has a crankshaft 202 thereof on which a flywheel 203 is rigidly fitted. The flywheel 203 has a ring gear 204 integrally formed around a peripheral surface thereof.

On the other hand, the starter system 80 includes the ring gear 204 (driven gear), a pinion gear 212 (driving gear), an output shaft 213 (third rotational shaft) having one end thereof connected to the pinion gear 212, a magnet switch (MG.SW) 214 for moving the pinion gear 212 toward the ring gear 204 at the start of the engine so as to bring the pinion gear 212 into meshing engagement with the ring gear 204, a hydraulic motor 215 (hydraulic actuator) for driving the pinion gear 212 for rotation at the start of the engine, a hydraulic motor-driving mechanism 216 for driving the hydraulic motor 215, an electric motor 217 for auxiliary drive, and an ECU 205 for controlling operations of the hydraulic motor 215 and other devices.

The pinion gear 212 is formed by a helical gear meshable with the ring gear 204. The pinion gear 212 is rigidly fitted on one end portion of a pinion shaft 212*a* which is coaxially splined to the output shaft 213, whereby the pinion gear 212 is coupled to the output shaft 213 such that the pinion gear 212 can rotate in unison with the output shaft 213 and at the same time move in the axial direction.

The magnet switch 214 is formed by a solenoid comprised of a plunger 214*a*, and an exciting coil and a return spring incorporated therein, neither of which is shown. The plunger 214*a* extends coaxially with the output shaft 213. According to this construction, when the magnet switch 214 is in a non-excited state, the plunger 214*a* is axially opposed to the pinion shaft 212*a* of the pinion gear 212 with a space therebetween, whereby the pinion gear 212 is held in a non-engagement position (i.e. a state shown in FIG. 8) where the pinion gear 212 is inhibited from meshing with the ring gear 204. On the other hand, when the magnet switch 214 is excited, the plunger 214*a* is caused to project to urge the pinion shaft 212*a* toward the engine 201, whereby the pinion gear 212 is driven to an engagement position, not shown, for meshing engagement with the ring gear 204.

The hydraulic motor 215 is a swash-plate type, for instance, and driven by hydraulic pressure supplied from the hydraulic motor-driving mechanism 216. The hydraulic motor 215 has a rotational shaft 215*a* (first rotational shaft) thereof extending in parallel with the output shaft 213 and connected to the same via an overdrive gear train 218 comprised of an output gear 215*b* integrally formed with the rotational shaft 215*a* and intermediate gears 218*a*, 218*b*, and a first one-way clutch 219 (first driving force-transmitting mechanism). The first one-way clutch 219 is configured such that it allows transmission of torque only when the hydraulic motor 215 is driven to drive the output shaft 213, but cuts off torque when the rotational relationship is opposite to this.

On the other hand, the electric motor 217 drives the pinion gear 212 for rotation in place of the hydraulic motor 215 to perform the operation for starting the engine 201 auxiliarily when the starting of the engine 201 by the hydraulic motor 215 is disabled or unsuitable. For instance, when the engine 201 is in a very low-temperature condition, the startability of the engine 201 is low due to an increase in friction of the same, so that it takes time to complete starting of the engine 201. The hydraulic motor 215, however, can provide torque only for a relatively short time period due to its construction, and cannot ensure stable starting of the engine 201. To overcome the problem, the electric motor 217 is used in starting the engine 201. A rotational shaft 217*a* of the electric motor 217 extends in parallel with the output shaft 213 and the rotational shaft 215*a* of the hydraulic motor 215, and connected to the output shaft 213 via a reduction gear train 220 comprised of an output gear 217*b* integrally formed with the rotational shaft 217*a*, and intermediate gears 220*a*, 220*b*, and a second one-way clutch 221 (second driving force-transmitting mechanism). Similarly to the first one-way clutch 219, the second one-way clutch 221 is configured such that it allows transmission of torque only when the electric motor 217 is driven to drive the output shaft 213.

The hydraulic motor-driving mechanism 216 includes an oil pump 222, an electric motor 223 for driving the oil pump 222 for pressure accumulation, and an accumulator 224 for accumulating hydraulic pressure boosted by the oil pump 222. The oil pump 222 is directly connected to a rotational shaft 223*a* of the electric motor 223, with a suction port thereof connected to a reserve tank 225 and a discharge port thereof connected to an inlet port 215*c* of the hydraulic motor 215 via an oil passage 226 provided with a check valve 227. A branch passage 226*a* branches from a portion of the oil passage 226 at a location downstream of the check valve 227. The accumulator 224 is arranged in the branch passage 226*a*. According to the construction described above, when the electric motor 223 is operated, the oil pump 222 is driven to boost hydraulic pressure and supply the boosted hydraulic pressure to the accumulator 224 via the check valve 227, whereby the hydraulic pressure is accumulated in the accumulator 224.

Further, a solenoid valve 228 is arranged in the oil passage 226 at a location between the accumulator 224 and the hydraulic motor 215. The solenoid valve 228 is a normally-closed type. More specifically, in a non-excited state, the solenoid valve 228 closes the oil passage 226, and when excited by a drive signal from the ECU 205, it opens the oil passage 226 to allow the hydraulic pressure accumulated in the accumulator 224 to be supplied to the hydraulic motor 215. Oil supplied to the hydraulic motor 215 is returned to the reserve tank 225 via a discharge port 215*d* of the hydraulic motor 215 and a return oil passage 229. Further, a hydraulic sensor 230 is inserted in the branch passage 226*a*, for detecting a hydraulic pressure POIL within the accumulator 224 and delivering a signal indicative of the sensed hydraulic pressure POIL to the ECU 205.

The ECU 205 is formed by a microcomputer including an I/O interface, a CPU, a RAM, and a ROM, none of which are shown. The ECU 205 delivers drive signals to the magnet switch 214, the electric motors 217, 223 and the solenoid valve 228 in response to an operating status of an ignition key, not shown, and signals from the hydraulic sensor 230 and the like, to thereby control respective operations of these devices.

Next, the operation of the starter system 80 constructed as above will be described. First, during operation of the engine 201, when the hydraulic pressure POIL within the accumulator 224, which is detected by the hydraulic sensor 230, has become equal to or lower than a predetermined level POILL, the electric motor 223 is driven to operate the oil pump 222, whereby hydraulic pressure boosted by the oil pump 222 is accumulated in the accumulator 224. It should be noted that the predetermined level POILL is set e.g. to a level high enough to drive the hydraulic motor 215. On the other hand, when the hydraulic pressure POIL has reached a predetermined upper limit level POILH higher than the predetermined level POILL, the operations of the electric motor 223 and the oil pump 222 are stopped. Thus, when the engine 201 is in operation, the hydraulic pressure POIL within the accumulator 224 is increased to a level high enough to drive the hydraulic motor 215, while after stoppage of the engine 201, the hydraulic status is maintained by the check valve 227.

When the engine 201 is to be started by the hydraulic motor 215, the magnet switch 214 is driven to shift the pinion gear 212 to the engagement position for meshing engagement with the ring gear 204, and at the same time the solenoid valve 228 is excited to open the oil passage 226. As a result, hydraulic pressure is supplied from the accumulator 224 to the hydraulic motor 215 to drive the hydraulic motor 215 for rotation. The rotation of the hydraulic motor 215 is increased by the overdrive gear train 218, and then transmitted to the output shaft 213 via the first one-way clutch 219. As a result, the pinion gear 212 rotates in unison with the output shaft 213 to cause rotation of the ring gear 204, whereby the engine 201 is started. In this case, since the second one-way clutch 221 is arranged between the output shaft 213 and the rotational shaft 217*a* of the electric motor 217, transmission of the driving force from the output shaft 213 to the electric motor 217 is completely inhibited.

On the other hand, when the engine 201 is to be started by the electric motor 217, the electric motor 217 is driven with the solenoid valve 228 held in the non-excited state. The rotation of the electric motor 217 is reduced by the reduction gear train 220, and then transmitted to the output shaft 213 via the second one-way clutch 221. As a result, the ring gear 204 is caused to rotate to start the engine 201. In this case as well, since the first one-way clutch 219 is arranged between the output shaft 213 and the hydraulic motor 215, transmission of the driving force from the output shaft 213 to the hydraulic motor 215 is completely inhibited. Further, after the engine 201 has been started and the rotational speed of the ring gear 204 has risen to exceed that of the pinion gear 212, the first and second one-way clutches 219, 221 cause only the output shaft 213 to perform idle or free rotation, so that the driving force of the engine 201 is transmitted neither to the hydraulic motor 215 nor to the electric motor 217.

As described above, according to the present embodiment, the hydraulic motor 215 and the electric motor 217 are arranged such that the rotational shaft 215*a* of the hydraulic motor 215 and the rotational shaft 217*a* of the electric motor 217 extend in parallel with each other, and respective driving forces of the hydraulic motor 215 and the electric motor 217 are selectively transmitted to the output shaft 213 via the first and second one-way clutches 219, 221 to start the engine 201. Therefore, whichever of the two motors 215 and 217 may be used, the engine 201 can be started by operating one of them independently of the other without causing any rotation of the other motor, i.e. in a state of transmission of driving force between the two motors being completely inhibited. This makes it possible to prevent wear of a brush of the electric motor 217 due to the use of the electric motor 217 in combination with the hydraulic motor 215, and an increase in rotational resistance due to friction resulting from the wear of the brush. Further, it is not necessary to provide an extra design so as to increase the robustness of the electric motor 217 to adapt the same to the high rotational speed characteristic of the hydraulic motor 215. Moreover, even when one of the hydraulic motor 215 and the electric motor 217 is disabled, e.g. due to an immovable operative status of the electric motor 217 or a condition unsuitable for the starting by the hydraulic motor, such as a very low temperature, it is possible to use the other to start the engine without any difficulty.

Furthermore, according to the present embodiment, since the rotational shaft 215*a* of the hydraulic motor 215 and the rotational shaft 217*a* of the electric motor 217 are connected to the output shaft 213 via the respective first and second one-way clutches 219, 221, it is possible to start the engine 201 by using one of the hydraulic motor 215 and the electric motor 217 and at the same time hold the other in a disconnected state by the simple construction, easily without any need to execute control operation therefor.

Figure 9:
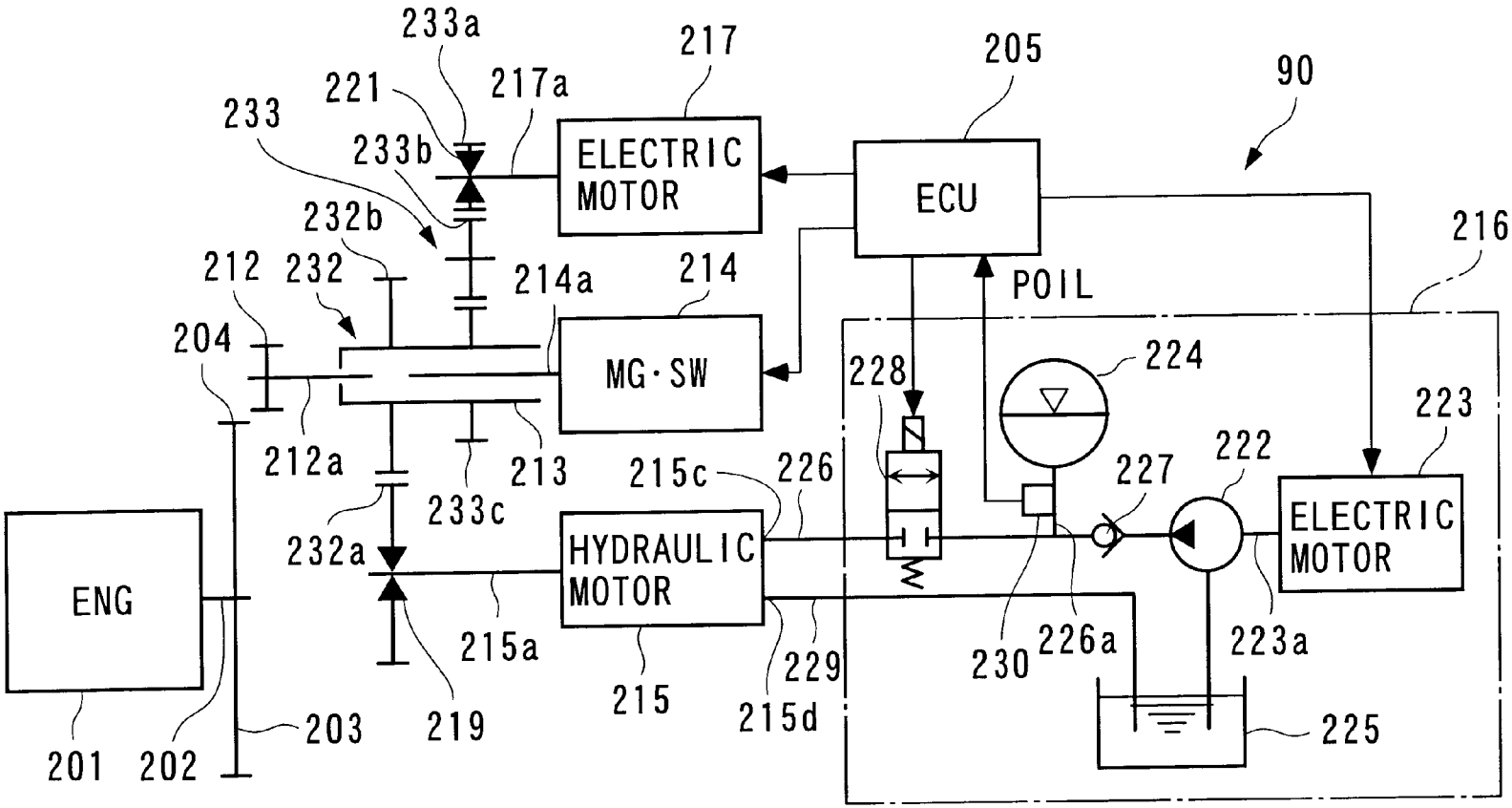
FIG. 9 is a diagram schematically showing the arrangement of a starter system for an internal combustion engine, according to a seventh embodiment of the invention.

FIG. 9 schematically shows the arrangement of a starter system according to a seventh embodiment of the invention. It should be noted that in the following description, component parts and elements similar or equivalent to those of the sixth embodiment are designated by identical reference numerals, and detailed description thereof is omitted when deemed proper. As shown in the figure, the starter system 90 is distinguished from the starter system 80 of the sixth embodiment in that the first and second one-way clutches 219, 221 are arranged, respectively, coaxially with the rotational shaft 215*a* of the hydraulic motor 215 and the rotational shaft 217*a* of the electric motor 217.

More specifically, the hydraulic motor 215 employed in the present embodiment is a higher-speed (smaller-sized) type than that in the sixth embodiment, and connected to the output shaft 213 via the first one-way clutch 219 provided on the rotational shaft 215*a* of the hydraulic motor 215, and a constant-speed gear train 232 comprised of an output gear 232*a* integrally formed with the first one-way clutch 219 and an input gear 232*b* integrally formed with the output shaft 213. On the other hand, the rotational shaft 217*a* of the electric motor 217 is connected to the output shaft 213 via the second one-way clutch 221 provided on the rotational shaft 217*a*, and a reduction gear train 233 comprised of an output gear 233*a* integrally formed with the second one-way clutch 221, an intermediate gear 233*b*, and an input gear 233*c* integrally formed with the output shaft 213. The seventh embodiment is similar in construction to the sixth embodiment except for the above points.

Therefore, according to the present embodiment, similarly to the sixth embodiment, the driving forces of the rotational shaft 215*a* of the hydraulic motor 215 and the rotational shaft 217*a* of the electric motor 217 extending in parallel with each other are selectively transmitted to the output shaft 213 via the respective first and second one-way clutches 219, 221 in a state of transmission of the driving forces between the two motors being completely inhibited, to thereby start the engine 201, and hence it is possible to provide the same advantageous effects as obtained by the above sixth embodiment.

It should be noted that the arrangement of the magnetic switch 214, the hydraulic motor 215 and the electric motor 217 with respect to the output shaft 213 is not limited to those shown in FIGS. 8 and 9, but lots of variations are possible. Although not shown, for instance, as the hydraulic motor 215, a high-rotational speed-type hydraulic motor may be employed and arranged coaxially with the output shaft 213. This makes it possible to dispense with the overdrive gear train 218, and thereby construct the starter system 80 compact in size. Further, as the electric motor 217, a low-rotational speed/high output power type may be employed, whereby the electric motor 217 can be arranged coaxially with the output shaft 213 without interposing the planetary gear set between the same and the output shaft 213. This makes it possible to omit the reduction gear train.

Figure 10:
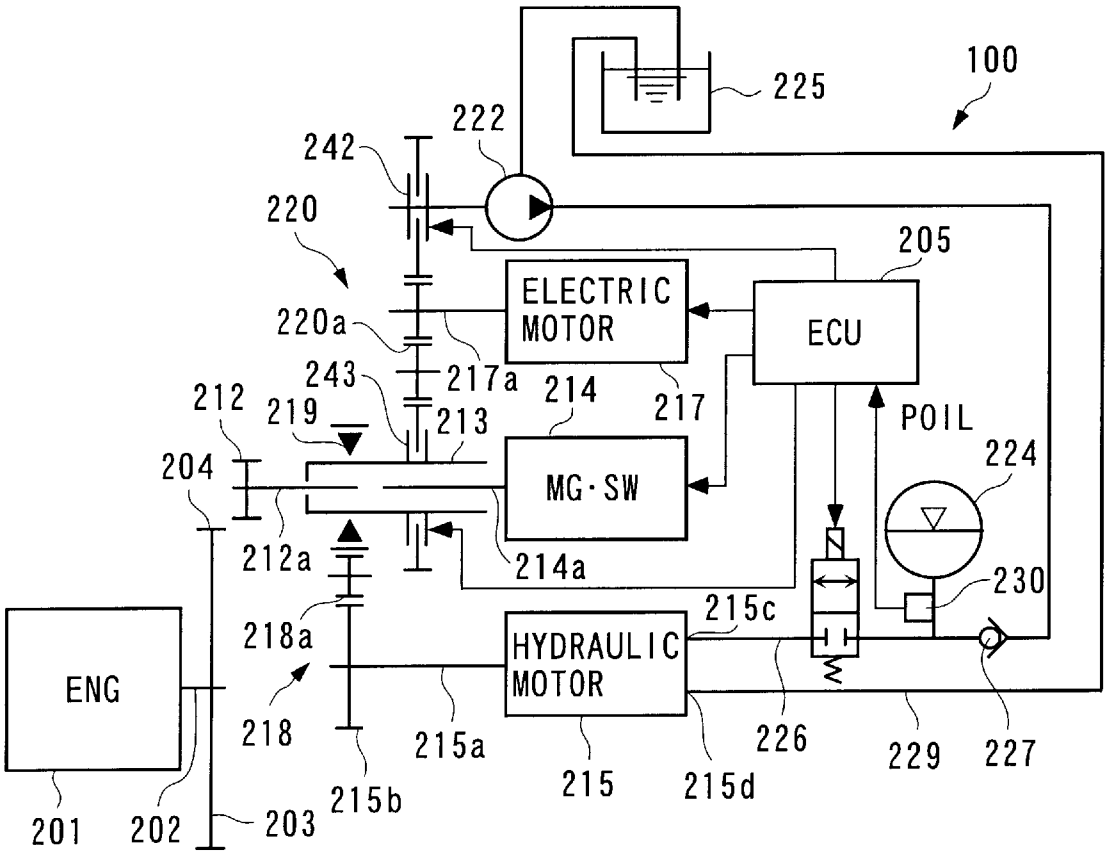
FIG. 10 is a diagram schematically showing the arrangement of a starter system for an internal combustion engine, according to an eighth embodiment of the invention.

FIG. 10 schematically shows the arrangement of a starter system according to an eighth embodiment of the invention. In the following description as well, component parts and elements similar or equivalent to those of the sixth embodiment are designated by identical reference numerals, and detailed description thereof is omitted when deemed proper. As shown in the figure, the starter system 100 according to the present embodiment is distinguished from the starter system 80 of the sixth embodiment in the following points: The rotational shaft 217*a* of the electric motor 217 is connected to the oil pump 222 via a first solenoid clutch 242. Further, the rotational shaft 217*a* of the electric motor 217 extends in parallel with the output shaft 213 and the rotational shaft 215*a* of the hydraulic motor 215, and a second solenoid clutch 243 (second driving force-transmitting mechanism) is arranged between the reduction gear train 220 and the output shaft 213, in place of the second one-way clutch 221 of the sixth embodiment. Accordingly, the electric motor 223 used in the sixth embodiment for pressure accumulation is omitted. The operations of the first and second solenoid clutch 242, 243 are controlled by the ECU 205. The eighth embodiment is similar in construction to the sixth embodiment except for the above points.

The starter system 100 is operated as follows. First, during operation of the engine 201, the second solenoid clutch 243 is held in a disengaged state, and when the hydraulic pressure POIL has become equal to or lower than the predetermined level POILL, the electric motor 217 is driven, and at the same time the first solenoid clutch 242 is engaged. This allows torque or rotation of the electric motor 217 to be transmitted to the oil pump 222 via the first solenoid clutch 242, whereby the oil pump 222 is driven to accumulate hydraulic pressure in the accumulator 224. On the other hand, when the hydraulic pressure POIL has reached the predetermined upper limit level POILH, the electric motor 217 is stopped and the first solenoid clutch 242 is disengaged. Thus, similarly to the starter system 80 of the sixth embodiment, the hydraulic pressure POIL within the accumulator 224 is preserved at a level high enough to drive the hydraulic motor 215.

When the engine 201 is to be started by the hydraulic motor 215, similarly to the sixth embodiment, the magnet switch 214 is driven, the solenoid valve 228 is excited, and at the same time the second solenoid clutch 243 is disengaged. As a result, the engine 201 is started, but the driving force of the output shaft 213 is cut off by the second solenoid clutch 243, i.e. not transmitted to the electric motor 217 at all. On the other hand, when the engine 201 is to be started by the electric motor 217, the electric motor 217 is driven, and at the same time the second solenoid clutch 243 is engaged, and the first solenoid clutch 242 is disengaged. As a result, the engine 201 can be started without transmitting the torque of the electric motor 217 to the oil pump 222 or the hydraulic motor 215. In this case as well, the driving force of the output shaft 213 is cut off by the first one-way clutch 219, and not transmitted to the hydraulic motor 215 at all.

As described above, according to the starter system 100, the second driving force-transmitting mechanism for transmitting the driving force from the electric motor 217 to the output shaft 213 is implemented by the second solenoid clutch 243 which is properly controlled by the ECU 205. Therefore, it is possible to start the engine 201 by the first one-way clutch 219 and the second solenoid clutch 243, in the state of transmission of the driving forces between the motors 215, 217 being completely cut off or inhibited. Therefore, the present embodiment can provide the same advantageous effects as obtained by the sixth and seventh embodiments. Further, since the starting of the engine 201 and accumulation of hydraulic pressure in the accumulator 224 can be carried out by the single electric motor 217, it is possible to make the starter system 100 more compact in size and manufacture the same at a lower cost than the starter system 80 of the sixth embodiment which necessitates two electric motors 217, 223.

Although not shown, the first one-way clutch 219 may be replaced by a solenoid clutch which is controlled by the ECU 205. Alternatively, the first and second solenoid clutches 242, 243 may be replaced by third and second one-way clutches, respectively, and a rotation-reversing circuit for driving the electric motor 217 in a direction opposite to that of rotation for starting the engine may be provided. In this case, the second one-way clutch allows transmission of torque of the electric motor 217 to the output shaft 213 only when the motor 217 performs normal rotation, while the third one-way clutch allows transmission of torque of the electric motor 217 to the oil pump 222 only when the motor 217 performs reverse rotation. According to this construction, by causing normal and reverse rotations of the electric motor 217, it is possible to carry out starting of the engine 201 and accumulation of hydraulic pressure in the accumulator 224, respectively. In short, so long as the driving force-transmitting mechanism is formed such that transmission and interruption of driving forces can be performed to meet requirements of the present embodiment, any device may be substituted for a one-way clutch or a solenoid clutch.

Although in the FIG. 10 example, the first solenoid clutch 242 and the oil pump 222 are arranged on a side of the electric motor 217 remote from the output shaft 213, the oil pump 222 may be connected to an idler shaft arranged in parallel between the rotational shaft 217*a* of the electric motor 217 and the output shaft 213. In this case, the first solenoid clutch 242 is used for engaging or disengaging an idler gear in meshing engagement with the rotational shaft 217*a* and the output shaft 213, with or from the idler shaft. This construction enables space to be saved and components to be used in a shared manner when an idler gear is required. Further, the first solenoid clutch 242 and the electric motor 217 may be arranged coaxially with each other.

Alternatively, the electric motor 217 may be constantly connected to the oil pump 222, and at the same time, a passage-switching mechanism may be provided for switching an outlet passage for the flow of oil from the oil pump 222 between the accumulator side and the reserve tank side. According to this construction, it is possible to drive the electric motor 217 and at the same time switch the outlet passage from the oil pump 222 to the accumulator side, thereby accumulating hydraulic pressure in the accumulator 224. Further, when the engine 201 is to be started by the electric motor 217, it is possible to switch the outlet passage from the oil pump 222 to the reserve tank side to relieve pressure, thereby reducing load on the electric motor 217. This construction is advantageous in terms of costs because the driving force-switching means including the expensive first and second solenoid clutches 242, 243 and the reversing circuit used in the eighth embodiment for enabling the electric motor 217 to be commonly used for the starting of the engine and accumulation of hydraulic pressure can be dispensed with. Further, since the passage-switching mechanism can be arranged separately from the starter mechanism including the magnet switch 214 and the hydraulic motor 215, the above construction also has an advantage in layout.

Figure 11:
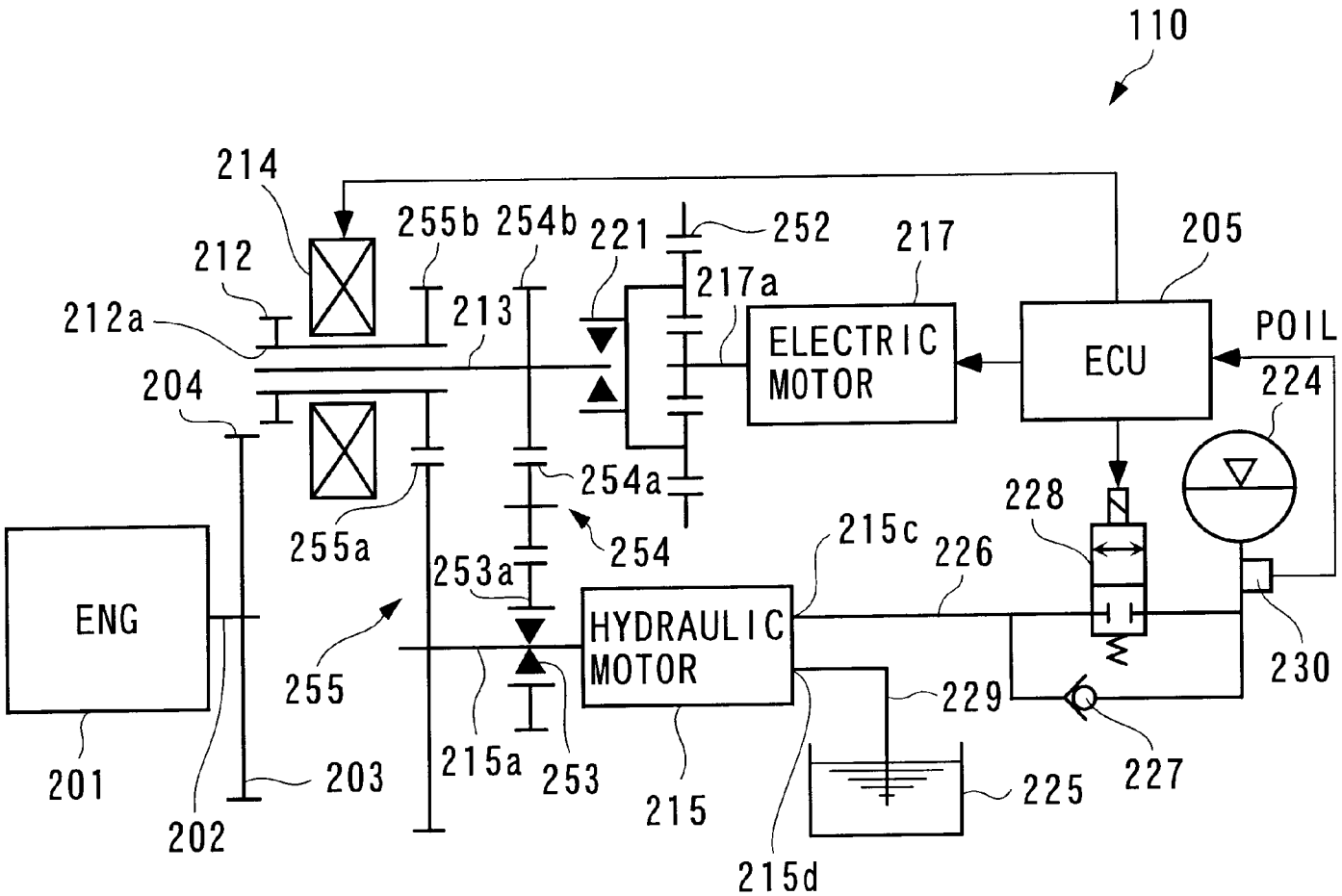
FIG. 11 is a diagram schematically showing the arrangement of a starter system for an internal combustion engine, according to a ninth embodiment of the invention.
Figure 12:
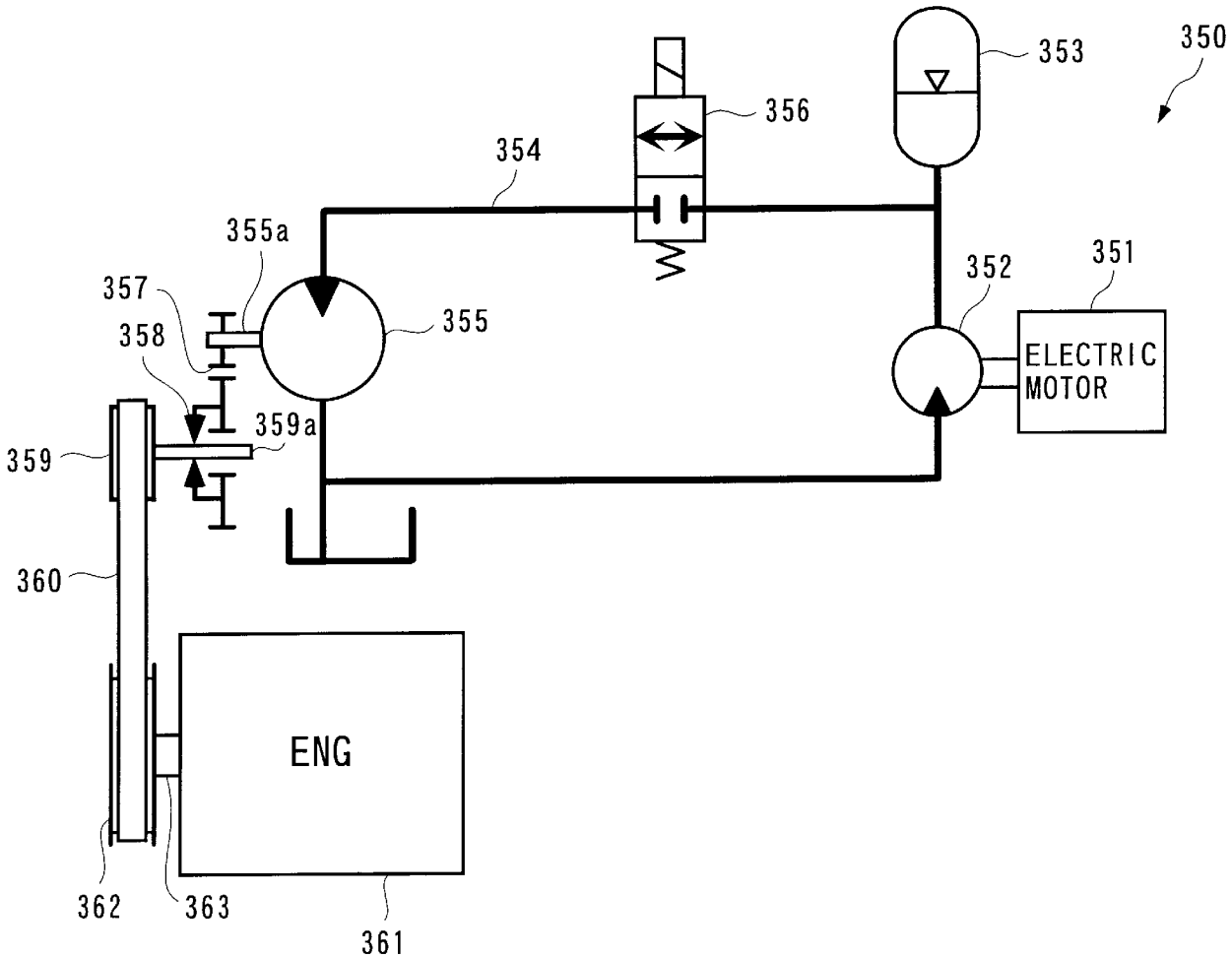
FIG. 12 PRIOR ART
FIG. 12 is a diagram schematically showing the arrangement of a conventional starter system for an internal combustion engine.

FIG. 11 schematically shows the arrangement of a starter system according to a ninth embodiment of the invention. In the following, component parts and elements similar or equivalent to those of the sixth embodiment are designated by identical reference numerals, and detailed description thereof is omitted when deemed proper. As shown in the figure, in the starter system 110 of the present embodiment, the check valve 227 and the solenoid valve 228 are arranged in parallel with each other in an intermediate portion of the oil passage 226, and the oil pump 222 in the sixth embodiment is omitted. The rotational shaft 217*a* of the electric motor 217 is connected to the output shaft 213 via a planetary gear set 252 and a second one-way clutch 221.

On the other hand, the rotational shaft 215*a* of the hydraulic motor 215 is connected to the output shaft 213 via a first one-way clutch 253 and a starting gear train 254 comprised of an output gear 253*a* integrally formed with the first one-way clutch 253, an intermediate gear 254*a*, and a gear 254*b* integrally formed with the output shaft 213. Further, the rotational shaft 215*a* of the hydraulic motor 215 has a gear 255*a* fitted on one end thereof, while the pinion shaft 212*a* has a gear 255*b* meshable with the gear 255*a*, fitted on one end thereof opposite to the other end thereof on which the pinion gear 212 is fitted. The gears 255*a*, 255*b* form a gear train 255 for use in pressure accumulation, and are in meshing engagement with each other (i.e. a state shown in FIG. 11) when the pinion gear 212 is held in the non-engagement position where the pinion gear 212 is inhibited from meshing engagement with the ring gear 204, whereas when the pinion gear 212 is held in the engagement position, the gears 255*a*, 255*b* are disengaged from each other.

The operation of the starter system 110 is as follows. First, when the engine 201 is to be started by the hydraulic motor 215, similarly to the sixth and eighth embodiments, the magnet switch 214 is driven, and at the same time the solenoid valve 228 is excited. This brings the pinion gear 212 into meshing engagement with the ring gear 204, and torque from the hydraulic motor 215 is transmitted to the output shaft 213 via the first one-way clutch 253 and the starting gear train 254, whereby the engine 201 is started. In this case, when the pinion gear 212 is shifted to the engagement position, the gear train 255 for pressure accumulation is brought into the disengaged state, so that the gear train 255 does not have any influence on the starting of the engine 201. Further, the driving force from the hydraulic motor 215 is cut off by the second one-way clutch 221, and not transmitted to the electric motor 221 at all.

On the other hand, when the engine 201 is to be started by the electric motor 217, the magnet switch 214 is driven, and at the same time the electric motor 217 is driven with the solenoid valve 228 held in the non-excited state. As a result, torque from the electric motor 217 is transmitted to the output shaft 213 via the planetary gear set 252 and the second one-way clutch 221, whereby the engine 201 is started. In this case, the disengaged state of the gear train 255 and the first one-way clutch 253 completely prevent the driving force of the electric motor 217 from being transmitted to the hydraulic motor 215.

During operation of the engine 201, with the magnet switch 214 held in an inoperative state, and the solenoid valve 228 in the non-excited state, the electric motor 217 is operated when the hydraulic pressure POIL becomes equal to or lower than the predetermined level POILL. As a result, torque of the electric motor 217 is transmitted to the output shaft 213 in the same way as when the engine is started, and then transmitted to the rotational shaft 215*a* of the hydraulic motor 215 via the gear train 255 in the engaged state. The first one-way clutch 253 prevents transmission of the torque from the electric motor 217 to the hydraulic motor 215 via the starting gear train 254. Accordingly, the hydraulic motor 215 is driven for rotation by the electric motor 217 only via the gear train 255 for pressure accumulation. At this time, the rotational shaft 215*a* rotates in an opposite direction to that of rotation thereof for starting the engine because the number of gear stages of the gear train 254 is different from that of gear stages of the gear train 255 by one. As a result, the hydraulic pressure boosted by the reverse rotation of the hydraulic motor 215 is supplied to the accumulator 224 via the inlet port 215*c* of the hydraulic motor 215, the oil passage 226 and the check valve 227, and stored therein. Then, when the hydraulic pressure POIL reaches the upper limit level POILH, the electric motor 217 is stopped.

As described above, in the starter system 110 of the present embodiment as well, the engine 201 can be started in the state of transmission of the driving forces between the two motors 215, 217 being completely cut off or inhibited by the respective first and second one-way clutches 253, 221, so that the present embodiment can provide the same advantageous effects as obtained by the sixth and seventh embodiments. Further, the hydraulic motor 215 can be switched by the starting gear train 254 or the gear train 255 for pressure accumulation, between a state driven for normal rotation by hydraulic pressure from the accumulator 224, for starting the engine 201, and a state driven for reverse rotation by the electric motor 217, for storing hydraulic pressure in the accumulator 224. As a result, it is possible to omit the oil pump 222 in the sixth embodiment, thereby further reducing the size and manufacturing costs of the starter system 110. Further, according to the present embodiment, the driving force-switching means including the first and second solenoid clutches employed in the eighth embodiment, for enabling the electric motor 215 to be commonly used for the starting of the engine and the accumulation of hydraulic pressure can be dispensed with, which also makes the starter system 110 advantageous in terms of costs.

Although in the present embodiment, the hydraulic motor 215 is reversely rotated to use the same as the oil pump, this is not limitative, but a swash-plate type hydraulic motor with a rotation-reversing mechanism may be employed as the hydraulic motor, and it may be used for the oil pump without causing the same to be rotated reversely. In this case, the intermediate gear 254*a* for reverse rotation of the hydraulic motor 215 can be dispensed with, and the number of component parts of the starter system can be reduced thereby.

It is further understood by those skilled in the art that the foregoing is a preferred embodiment of the invention, and that various changes and modifications may be made without departing from the spirit and scope thereof.

What is claimed is:

1. A starter system for an internal combustion engine, for starting the engine by driving a crankshaft for rotation, the starter system comprising:

a hydraulic actuator that is driven by hydraulic pressure;

a first rotational shaft that is driven for rotation by said hydraulic actuator;

an electric motor;

a second rotational shaft that extends in parallel with said first rotational shaft and is driven for rotation by said electric motor;

a driven gear that rotates in unison with the crankshaft;

a driving gear that is brought into meshing engagement with said driven gear when the engine is started;

a third rotational shaft that is connected to said driving gear;

a first driving force-transmitting mechanism that connects said first rotational shaft and said third rotational shaft to each other in a disconnectable manner, for transmitting rotation of said first rotational shaft to said third rotational shaft; and a second driving force-transmitting mechanism that connects said second rotational shaft and said third rotational shaft to each other in a disconnectable manner, for transmitting rotation of said second rotational shaft to said third rotational shaft.

2. A starter system according to claim 1, wherein said first and second driving force-transmitting mechanisms are formed by respective first and second one-way clutches that allow transmission of respective rotations of said first and second rotational shafts to said third rotational shaft only when said first and second rotational shafts rotate in respective directions for driving said third rotational shaft.

3. A starter system according to claim 1, including a planetary gear set having a sun gear, a carrier, and a ring gear, said second rotational shaft being connected to one of said sun gear, said carrier, and said ring gear, and wherein said first rotational shaft being connected to another of said sun gear, said carrier, and said ring gear of said planetary gear set, and said third rotational shaft being connected to a remaining one of said sun gear, said carrier, and said ring gear of said planetary gear set.

4. A starter system according to claim 3, further comprising first fixing means for fixing said one of said sun gear, said carrier, and said ring gear, to which said second rotational shaft that is driven by said electric motor for rotation is connected, when the engine is to be started by said hydraulic actuator, and second fixing means for fixing said another of said sun gear, said carrier, and said ring gear, to which said first rotational shaft that is driven by said hydraulic actuator for rotation is connected, when the engine is to be started by said electric motor.

5. A starter system according to claim 4, further comprising an accumulator for storing hydraulic pressure, an oil passage connected to said accumulator, and third fixing means for fixing said remaining one of said sun gear, said carrier and said ring gear, to which said third rotational shaft that is connected to said driven gear is connected, to thereby transmit a driving force of said electric motor to said hydraulic actuator and cause said hydraulic actuator to rotate said first rotational shaft in a direction opposite to a direction in which said first rotational shaft is driven for rotation, to thereby cause the hydraulic pressure to be accumulated in said accumulator via said oil passage.

6. A starter system according to claim 3, wherein said third rotational shaft is connected to said ring gear, said second rotational shaft is connected to said sun gear, and said first rotational shaft is connected to said carrier.

7. A starter system according to claim 1, further comprising a hydraulic pressure supply control valve arranged in said oil passage connected to said hydraulic actuator, for controlling the hydraulic pressure to be supplied to said hydraulic actuator via said oil passage, and a torque limiter mechanism for suppressing an increase in the hydraulic pressure when a reverse torque equal to or larger than a predetermined value and acting in a direction opposite to a direction for starting the engine acts on said hydraulic actuator during stoppage of rotation of the engine.

8. A starter system according to claim 7, wherein said torque limiter mechanism is a relief valve arranged in said oil passage, for opening said oil passage when the hydraulic pressure in said oil passage becomes equal to or larger than a predetermined pressure corresponding to the reverse torque equal to or larger than the predetermined value.

9. A starter system according to claim 7, wherein said torque limiter mechanism is a clutch arranged between the engine and said hydraulic actuator, for suppressing an increase in the reverse torque transmitted from the engine to said hydraulic actuator, when the reverse torque becomes equal to or larger than the predetermined value.

10. A starter system according to claim 1, further comprising a discharge oil passage for discharging the hydraulic pressure from said hydraulic actuator, and wherein said hydraulic pressure supply control valve can open or close said oil passage and the discharge oil passage simultaneously.

* * * * *